US006756189B2

(12) United States Patent
Gibson et al.

(10) Patent No.: US 6,756,189 B2
(45) Date of Patent: Jun. 29, 2004

(54) PHOTOGRAPHIC ELEMENTS CONTAINING CYAN COUPLER UV ABSORBER AND STABILIZER

(75) Inventors: Danuta Gibson, Hertfordshire (GB); Llewellyn J. Leyshon, Harrow (GB); David Clarke, Harrow (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/269,142

(22) Filed: Oct. 11, 2002

(65) Prior Publication Data

US 2003/0232289 A1 Dec. 18, 2003

(30) Foreign Application Priority Data

Nov. 10, 2001 (GB) ..... 0127068

(51) Int. Cl.[7] ..... G03C 7/46; G03C 1/46; G03C 1/08

(52) U.S. Cl. ..... 430/384; 430/502; 430/503; 430/543; 430/552; 430/553; 430/551; 430/558; 430/512; 430/931; 430/372

(58) Field of Search ..... 430/502, 503, 430/543, 552, 553, 551, 558, 512, 931, 372, 384

(56) References Cited

U.S. PATENT DOCUMENTS

| | | | | |
|---|---|---|---|---|
| 4,749,645 A | | 6/1988 | Goddard et al. | |
| 4,980,275 A | * | 12/1990 | Goddard | 430/551 |
| 5,035,988 A | | 7/1991 | Nakamura et al. | |
| 5,084,375 A | | 1/1992 | Umemoto et al. | |
| 5,192,650 A | | 3/1993 | Seto et al. | |
| 5,731,137 A | | 3/1998 | Saito et al. | |
| 6,004,738 A | | 12/1999 | Lau et al. | |
| 6,444,412 B1 | * | 9/2002 | Clarke et al. | 430/372 |
| 6,444,417 B1 | * | 9/2002 | Clarke et al. | 430/551 |

FOREIGN PATENT DOCUMENTS

| | | |
|---|---|---|
| DE | 197 01 869 | 9/1997 |
| EP | 1 191 396 | 3/2002 |
| EP | 1 191 398 | 3/2002 |

* cited by examiner

*Primary Examiner*—Geraldine Letscher
(74) *Attorney, Agent, or Firm*—Arthur E. Kluegel

(57) ABSTRACT

Disclosed is a colour photographic element containing one or more cyan dye-forming couplers, a UV absorber and a specific class of stabiliser, and an imaging process used therewith. The element exhibits improved stability.

31 Claims, No Drawings

PHOTOGRAPHIC ELEMENTS CONTAINING CYAN COUPLER UV ABSORBER AND STABILIZER

FIELD OF THE INVENTION

The present invention relates to a colour photographic element containing one or more cyan dye-forming couplers, in particular one or more phenolic cyan dye-forming couplers, a UV absorber and a specific class of stabilizer.

BACKGROUND OF THE INVENTION

In any chromogenic photographic material it is desirable that the dyes formed should have certain properties. For instance the dyes should be bright in colour, absorbing light in the appropriate spectral region, with very little secondary absorption so that good colour reproducibility is obtained. It is important that the formed photographic images should be resistant towards fading due to heat, humidity and light. The coupler should produce a dye efficiently in the dye-forming reaction during photographic development, it must be easily dispersible, and must itself be resistant towards the effect of light heat and humidity. This is very difficult to achieve. There is still a need for cyan dye-forming couplers providing dyes which are stable to the deleterious effects of heat humidity and light.

Cyan dye-forming couplers of the general structure described in this invention are well known, for example as described in U.S. Pat. Nos. 2,367,531, 2,423,730, 2,474,293, 2,772,161, 2,772,162, 2,895,826, 2,920,961, 3,002,836, 3,034,892, 3,041,236, 3,466,622, 3,476,563, 3,552,962, 3,758,308, 3,779,763, 3,839,044, 3,880,661, 3,998,642, 4,333,999, 4,883,746, 4,990,436, 4,960,685, 5,476,757 and 5,614,357, UK Patent No. 2,070,000, French Patent Nos. 1,478,188 and 1,479,043, European Patent Application Nos. 0 544 322, 0 556 700, 0 556 777, 0 565 096, 0 570 006 and 0 574 948, DE patent application No. 197 01 869 and "Farbkuppler-eine Literature Übersicht," published in Agfa Mitteilungen, Band III, pp. 156–175 (1961).

The use of cyclic bisphenol phosphate or phosphonate esters to improve the stability of cyan image dyes is shown in JP 02008839, in EP-A-1 197 798 and in U.S. Pat. Nos. 4,749,645 and 6,004,738. In the latter the cyclic bisphenol phosphonate esters are combined with phenolic coupler solvents to provide the required dye stability derived from the cyan couplers. The use of a cyclic silicon-blocked bisphenol to improve the stability for cyan dyes has been described in EP-A-1 191 398.

It is well-known that the spectral characteristics of the image dyes from these couplers can be manipulated by incorporating different functional groups into the molecular structure of the coupler and that the environment in which the dye is situated can also influence the hue of the dye. The use of certain solvents, like phenolic coupler solvents, can shift the dye absorption band to desirable longer wavelengths, as described in U.S. Pat. No. 5,376,519 and JP 59171953. One disadvantage of the use of these phenolic coupler solvents is that the resultant image is prone to thermally-induced increases in density, which is the result of morphological changes to the image structure which increase the covering power of the dye. Another disadvantage of these phenolic coupler solvents is their high viscosity which requires the use of an auxiliary organic solvent to enable the formation of small droplets (<0.25 micrometers in diameter) during homogenisation of the coupler dispersions during manufacture.

The use of benzotriazole UV absorbers for improving dye stability (especially light stability) of phenolic cyan couplers is well known, as shown by the following: U.S. Pat. Nos. 4,820,614, 5,084,375, 5,047,314 and EP-A-0 271 005. However, none of these describes a cyan coupler in combination with a UV absorber and bisphenol derivative (such as a cyclic phosphonate, or a silicon- or boron-blocked compound).

Dispersions with small droplets have many desirable properties, for example, reduced propensity to crystal formation, increased efficiency of the dye-forming reaction during development and improved resistance to abrasion of the final coating. However when an auxiliary organic solvent is used in the preparation of small droplet dispersions this solvent has to be removed before coating, usually by evaporation or by washing. It takes a long time to remove the auxiliary solvent and this is costly in time and equipment. In addition, with ever-increasing environmental concerns, reducing the amount of auxiliary organic solvent used in dispersions has been of paramount importance. Alternative methods for providing dispersions with small droplets without auxiliary solvent are to increase the homogenisation temperature, pressure or even to re-homogenise the dispersion, all of which are costly. Another alternative is to blend the phenolic coupler solvent with another high boiling solvent of lower viscosity, which affects, however, the desirable hue and stability properties of the coupler.

PROBLEM TO BE SOLVED BY THE INVENTION

There is still a need to provide a photographic element containing a dispersion of one or more cyan dye-forming couplers, which can provide further improved light and dark stability under normal storage conditions and high reactivity for formation of dye with oxidized colour developing agent.

SUMMARY OF THE INVENTION

The invention provides a photographic element comprising at least one light-sensitive silver halide emulsion layer having associated therewith at least one cyan dye-forming coupler, a UV absorber and a stabilizer of formula (I)

(I)

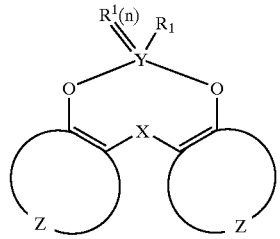

wherein

Y is phosphorous, silicon or boron;

$R_1$ and $R^1$ are independently selected from an unsubstituted or substituted alkyl, aryl, alkoxy, aryloxy group or a substituted amino group;

n is 0 or 1;

provided also that when (a) Y is phosphorous, n is 1 and $R^1$ is oxygen (=O);

(b) Y is silicon, n is 1 and $R_1$ and/or $R^1$ may also be hydrogen, or $R_1$ and $R^1$ may combine to complete a 5–10 membered heterocyclic ring which may contain, in addition to Y, one or more heteroatoms selected from nitrogen, oxygen and sulfur, which ring is unsubstituted or substituted; and (c) Y is boron, n is 0;

each Z independently represents the atoms necessary to complete a substituted or unsubstituted arene or heteroaromatic ring system; and X is a single bond or a linking group having an atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

In another embodiment of the invention there is provided a multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element is as herein described.

In yet another embodiment of the invention there is provided a process of forming an image in a photographic element as hereinbefore defined after the element has been imagewise exposed to light, comprising contacting the element, as herein described, with a colour developing agent.

ADVANTAGEOUS EFFECT OF THE INVENTION

This invention allows for improved light and dark stability in a photographic element without degradation in hue or reactivity of the dyes therein by the use of a combination of one or more cyan dye-forming couplers, a UV absorber and a cyclic phosphonate or silicon- or boron-blocked stabilizer.

DETAILED DESCRIPTION OF THE INVENTION

The invention is as described in the Summary of the Invention and relates to a photographic element containing at least one cyan dye-forming coupler combined with a UV absorber and a stabilizer, which enables there to be minimization of the amounts of coupler and silver necessary to achieve good photographic images, improved light stability and good thermal stability for album keeping.

As used herein and throughout the specification unless where specifically stated otherwise, the term "alkyl" refers to an unsaturated or saturated, straight or branched chain alkyl group, including alkenyl and aralkyl, and includes cyclic alkyl groups, including cycloalkenyl, having 3–8 carbon atoms and the term "aryl" includes specifically fused aryl.

Stabilizer of Formula (I)

The stabilizer has the formula (I)

(I)

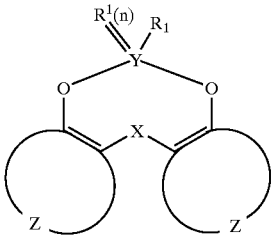

wherein

Y is phosphorous, silicon or boron;

$R_1$ and $R^1$ are independently selected from an unsubstituted or substituted alkyl, aryl, alkoxy, aryloxy group or a substituted amino group;

n is 0 or 1:

provided also that when (a) Y is phosphorous, n is 1 and $R^1$ is oxygen (=O);

(b) Y is silicon, n is 1 and $R_1$ and/or $R^1$ may also be hydrogen or $R_1$ and $R^1$ may combine to complete a 5–10 membered heterocyclic ring which may contain, in addition to Y, one or more heteroatoms selected from nitrogen, oxygen and sulfur, which ring is unsubstituted or substituted; and (c) Y is boron, n is 0;

each Z independently represents the atoms necessary to complete a substituted or unsubstituted arene or heteroaromatic ring system; and X is a single bond or a linking group having an atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

Preferably the stabiliser has the structure (IA)

(IA)

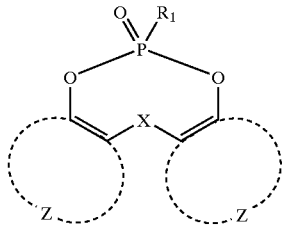

although the structures below are additionally within the scope of formula (1):

(IB)

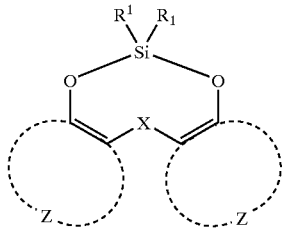

(IC)

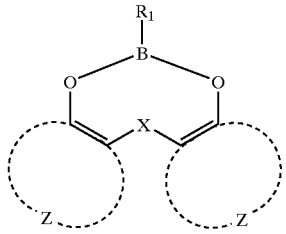

Suitably $R_1$ and/or $R^1$ may be, for example, an unsubstituted or substituted methyl, ethyl, butyl, octyl, nonyl, dodecyl, octadecyl, phenyl, methoxy, ethoxy, decyloxy, phenoxy or dimethylamino group or, when Y is a silicon atom, $R_1$ and/or $R^1$ may be hydrogen or $R_1$ and $R^1$ may combine to form, for example, a cyclopentyl, cyclohexyl or 1-oxa-4-silacyclohexyl ring.

Each Z represents the atoms necessary to form an arene or heteroaromatic ring, such as a naphthalene, pyridine or quinoline ring, but preferably the atoms complete a phenyl ring, which may be substituted, especially at the ortho and para positions.

X is a single bond or a linking group that presents an atom between the arene or heteroaromatic ring systems and is preferably a divalent linking group selected from —CR'R"—, —NR—, —$S(O)_q$— and —O—, wherein R is an unsubstituted or substituted alkyl or aryl group, R' and R" are independently selected from hydrogen and an unsubstituted or substituted alkyl or aryl group and q is 0, 1 or 2. Alternatively X may, together with substituents ortho to X on the arene or heteroaromatic ring systems, complete a fused 5-, 6- or 7-membered fused ring system which may be substituted or contain one or two heteroatoms selected from nitrogen, oxygen and sulfur. However X is preferably a sulfur atom or an oxygen atom or more preferably an unsubstituted or substituted methylene group.

A more preferred formula (I) is represented by formula (ID)

(ID)

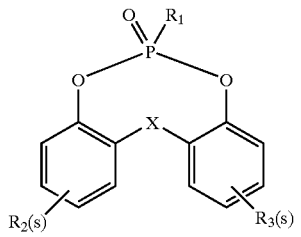

wherein $R_1$ and X are as defined above and each $R_2$ and each $R_3$ is independently selected from a halogen atom or an unsubstituted or substituted alkyl, aryl, alkoxy, aryloxy, COOR or CONR'R" group, where R, R' and R" are as hereinbefore defined, and is preferably a halogen atom or an alkyl or aryl or alkoxy group. Each s is independently an integer from 0 to 4 but conveniently each s is 2 and the substituents are preferably in the ortho and para positions with respect to the C—O bond. More especially in the ortho position there is an unsubstituted secondary or tertiary alkyl group and in the para position there is a halogen atom or an unsubstituted alkyl group. For ease of synthesis it is preferred that any substituents in the ortho positions of the phenyl rings match each other, as do those in the para position.

Specific examples of a stabilizer of formula (I) include the following, although the invention is not to be construed as limited thereto:

ST1

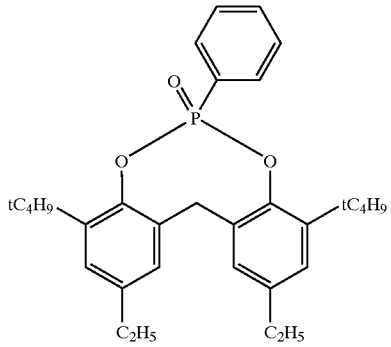

ST2

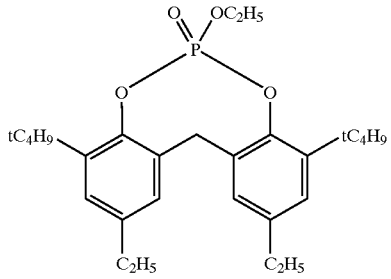

ST3

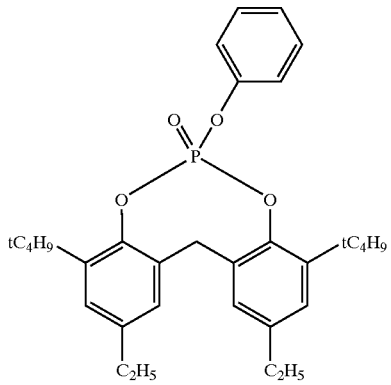

ST4

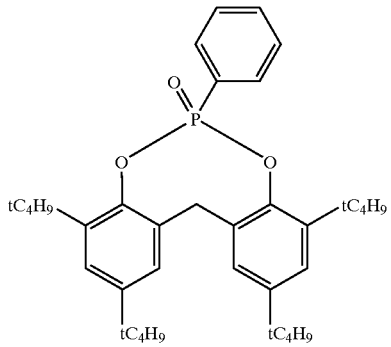

-continued
ST5
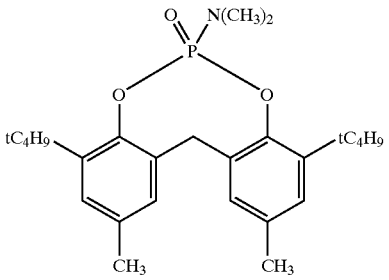
ST6
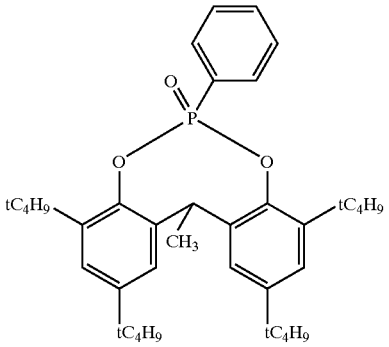
ST7
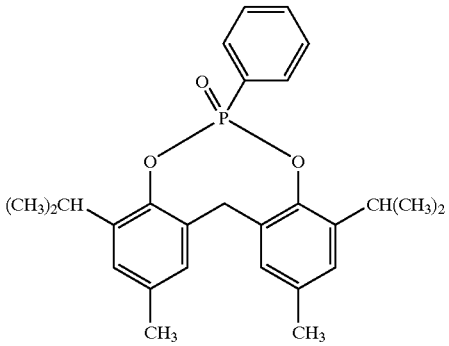
ST8
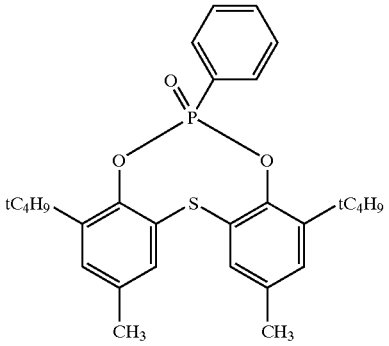
-continued
ST9
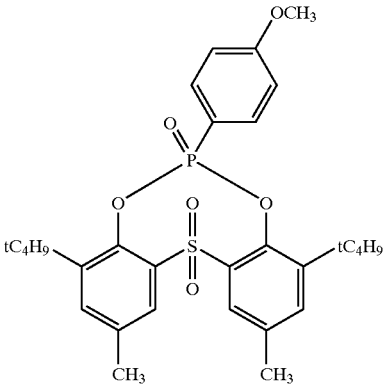
ST10
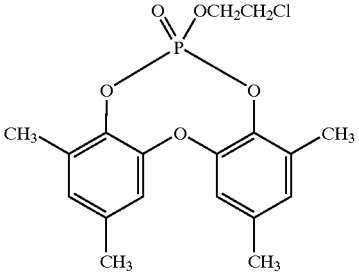
ST11
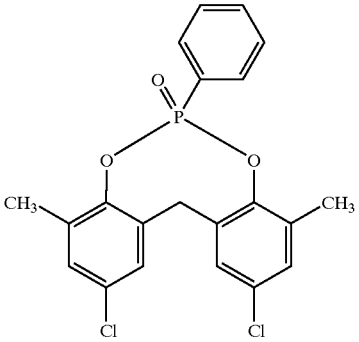
ST12
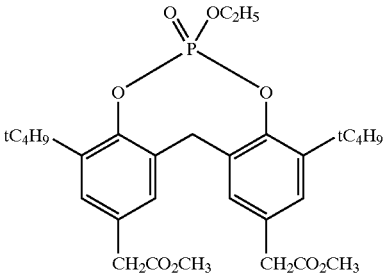

-continued
ST13
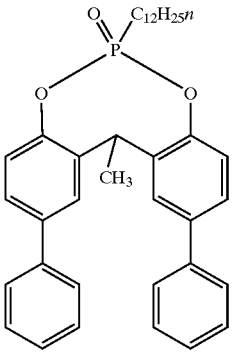
ST14
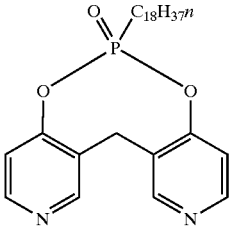
ST15
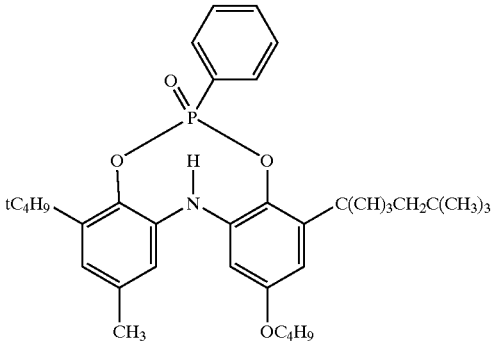
ST16
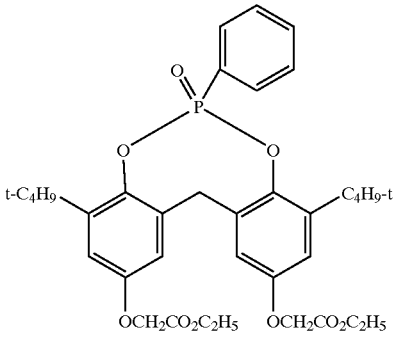
-continued
ST17
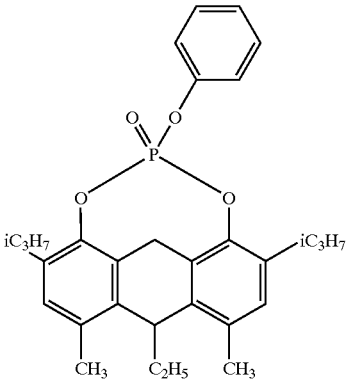
ST18
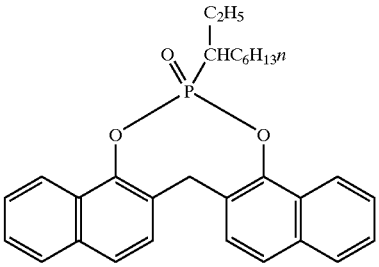
ST19
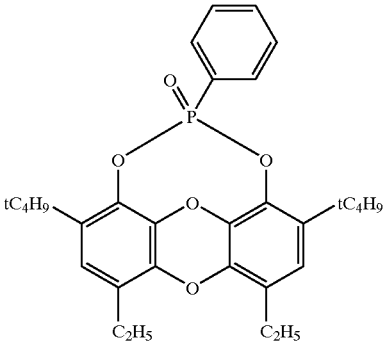
ST20
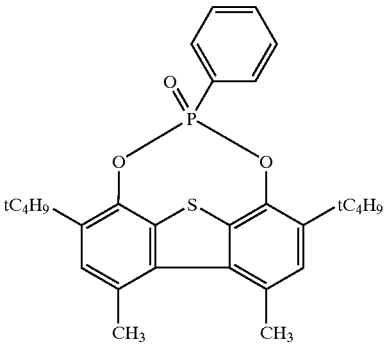
ST21
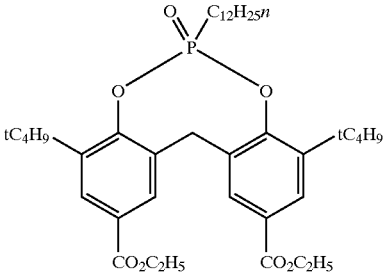

-continued
ST22
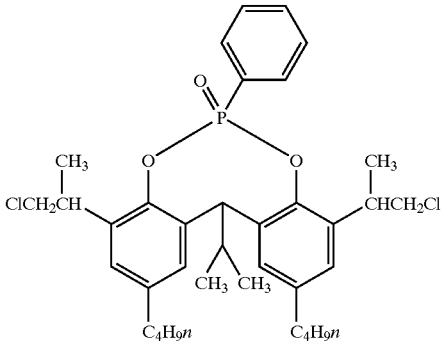
ST23
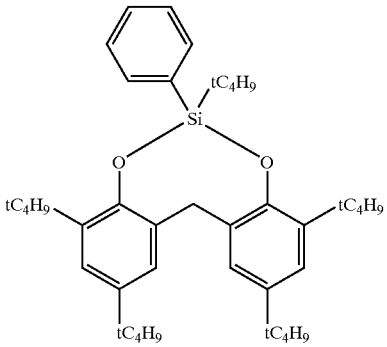
ST24
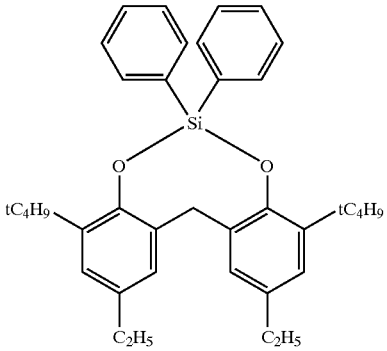
ST25
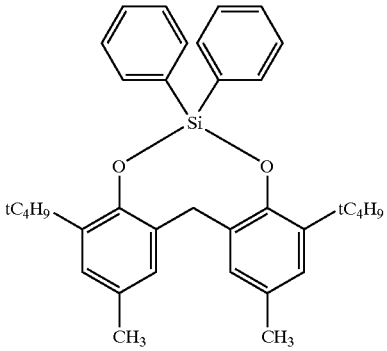
-continued
ST26
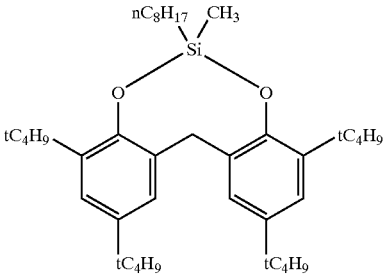
ST27
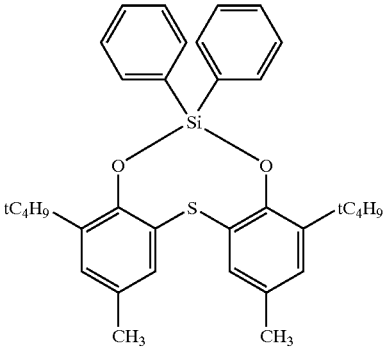
ST28
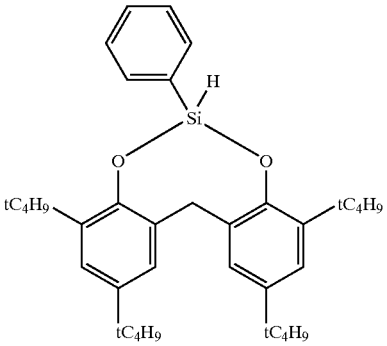
ST29
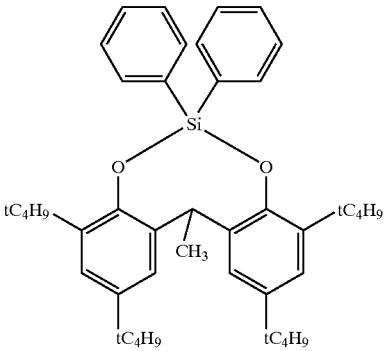

-continued
ST30
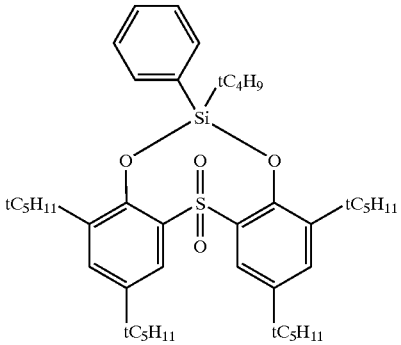
ST31
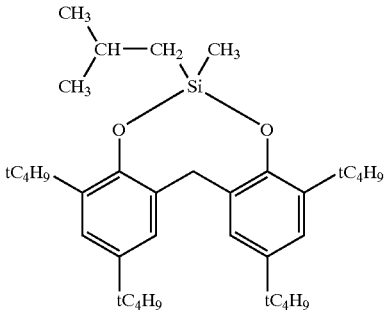
ST32
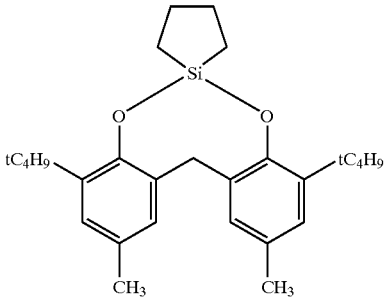
ST33
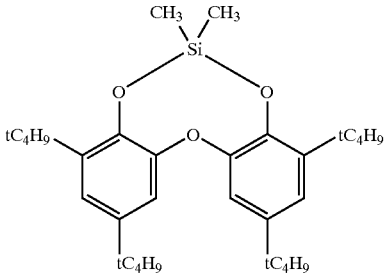
ST34
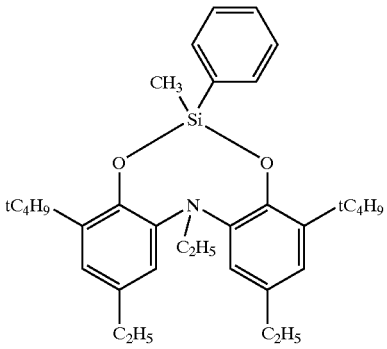
-continued
ST35
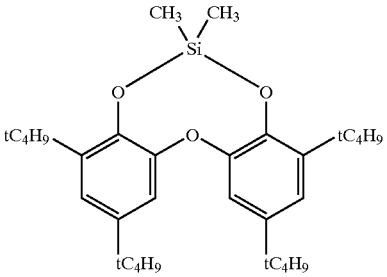
ST36
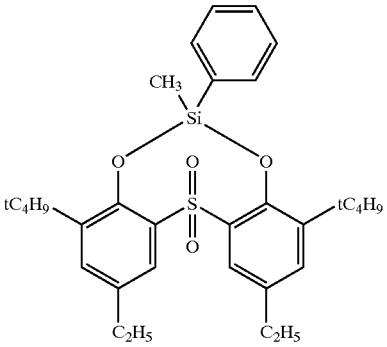
ST37
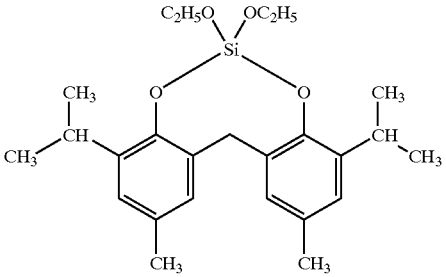
ST38
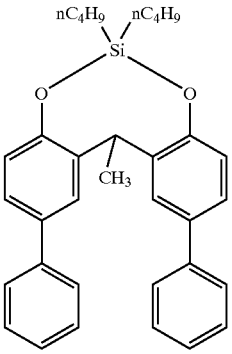
ST39
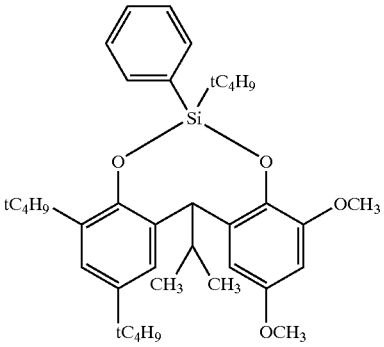

-continued
ST40
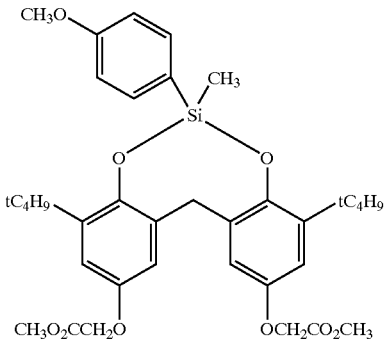
ST41
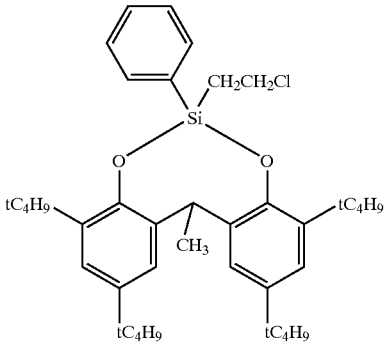
ST42
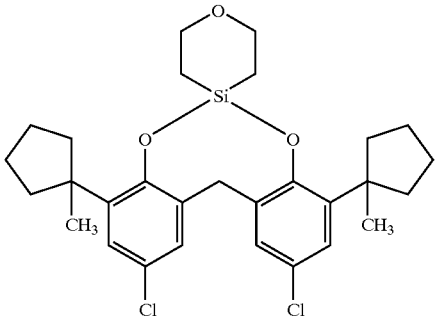
ST43
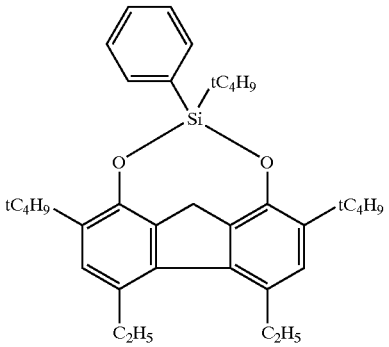
-continued
ST44
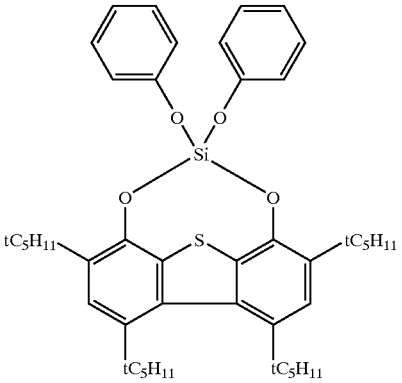
ST45
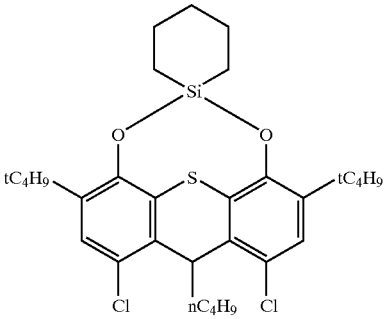
ST46
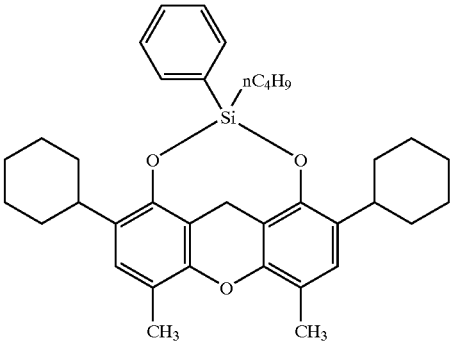
ST47
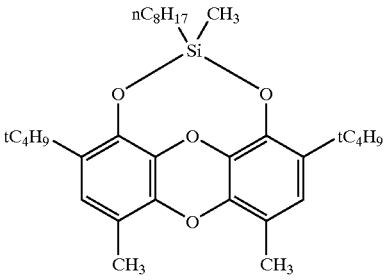

-continued

ST48

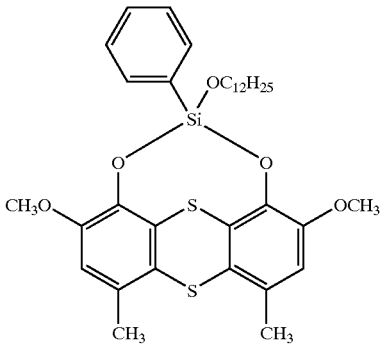

ST49

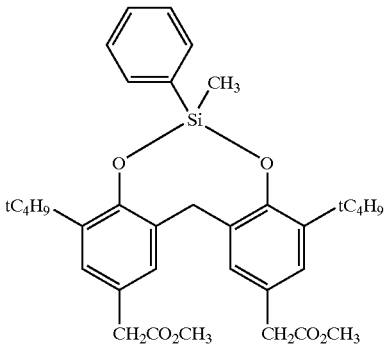

ST50

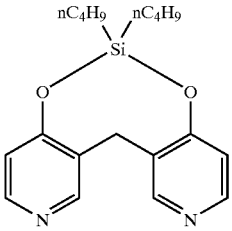

ST51

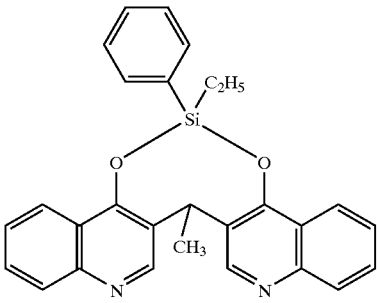

ST52

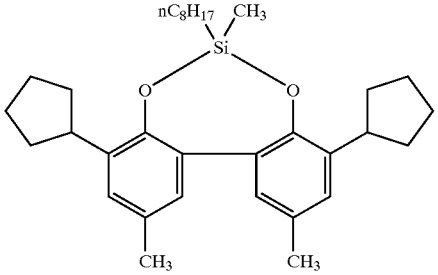

-continued

ST53

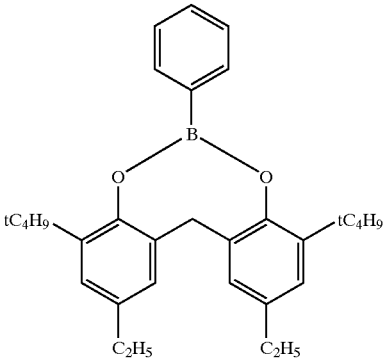

ST54

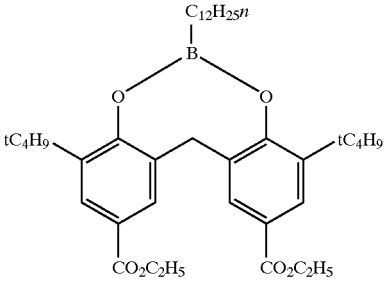

In one embodiment of the invention the cyan dye-forming coupler that can be used with advantage either alone or in combination with another cyan dye-forming coupler is a phenolic dye-forming coupler of formulae (II):

(II)

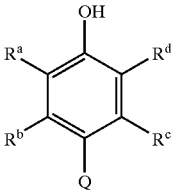

wherein $R^a$ is selected from hydrogen, halogen or an unsubstituted or substituted alkyl, aryl, alkyl- or aryl-amido, alkyl- or aryl-sulfonamido or alkyl- or aryl-ureido group, or a 5–10 membered heterocyclic ring which contains one or more heteroatoms selected from nitrogen, oxygen and sulfur, which ring is unsubstituted or substituted;

$R^b$ is selected from hydrogen or an unsubstituted or substituted alkyl, alkyl- or aryl-amido, alkyl- or aryl-ureido group or an amido or ureido group containing a 5–10 membered heterocyclic ring which contains one or more heteroatoms selected from nitrogen, oxygen and sulfur, which ring is unsubstituted or substituted;

$R^c$ is selected from a hydrogen atom or an oxygen atom linked with $R^d$ to form an oxazole group, which can be farther substituted;

$R^d$ is selected from an unsubstituted or substituted alkyl- or aryl-amido, alkyl- or aryl-sulfonamido or alkyl- or aryl-ureido group, or an amido, sulfonamido or ureido group containing a 5–10 membered heterocyclic ring which contains one or more heteroatoms selected from nitrogen, oxygen and sulfur, which ring is unsubstituted or substituted, or is a nitrogen atom linked with $R^c$ to form the oxazole group; and Q is selected from hydrogen or halogen or a group which can be split off by the reaction of coupler with an oxidized colour developing agent In a preferred embodiment a cyan dye-forming coupler may have the structure (IIA)

(IIA)

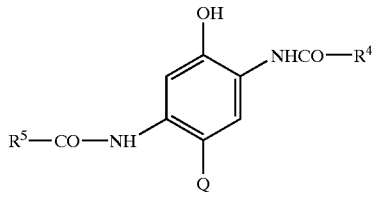

wherein $R^4$ and $R^5$ are independently selected from an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and Q is hydrogen or halogen or a group which can be split off by the reaction of the coupler with an oxidized colour developing agent.

When $R^4$ and/or $R^5$ are an amino or alkoxy group they may, for example, be substituted with a halogen, aryl, aryloxy or alkyl- or aryl-sulfonyl group, which may be further substituted. Suitably, however, $R^4$ and $R^5$ are independently selected from an unsubstituted or substituted alkyl or aryl group, such as a naphthyl group or more especially a phenyl group, or a 5–10 membered heterocyclic ring, such as a pyridyl, thienyl, morpholino, imidazolyl or pyridazolyl group.

However $R^4$ is preferably an unsubstituted or substituted aryl or heterocyclic ring substituted, in particular, with an electron-withdrawing substituent (Hammett's sigma para value greater than 0) in a position meta and/or para to the amido group. Hammett's sigma values may be obtained from "Substituent constants for Correlation Analysis in Chemistry and Biology" by Hansch and Leo, available from Wiley and Sons, New York, N.Y. (1979).

For example the aryl or heterocyclic ring may be substituted with a cyano, chloro, fluoro, bromo, iodo, alkyl- or aryl-carbonyl, alkyl- or aryl-oxycarbonyl, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, aryl, alkyl, alkoxy, aryloxy, nitro, alkyl- or aryl-ureido or alkyl- or aryl-carbamoyl group, any of which may be further substituted. Preferred groups are halogen, cyano, trifluoromethyl, alkoxycarbonyl, alkylsulfamoyl, alkylsulfonamido, alkylsulfonyl, carbamoyl, alkylcarbamoyl, carbonamido or alkylcarbonamido. When $R^5$ is an aryl or heterocyclic ring it may be similarly substituted Suitably, $R^4$ is a 4-chlorophenyl, 3,4-dichlorophenyl, 3,5-dichlorophenyl, 3,4-difluorophenyl, 3,5-difluorophenyl, 4-cyanophenyl, 3-chloro-4-cyanophenyl or pentafluorophenyl group.

$R^5$ is more preferably an alkyl group substituted, for example, with an alkyl, aryloxy or alkyl- or aryl-sulfonyl group, which may be further substituted. When $R^4$ is an alkyl group it may be similarly substituted.

In particular $R^5$ may be a group of the formula:

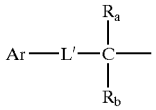

wherein

Ar is an unsubstituted or substituted aryl group, such as a phenyl or naphthyl group, L' is a divalent linking group such as —O—, —SO—, or —$SO_2$—, and $R_a$ and $R_b$ are independently H or an alkyl group.

More particularly, each substituent on the aryl group may be a halogen atom, an alkyl group such as methyl, t-butyl, heptyl, dodecyl, pentadecyl, octadecyl or 1,1,2,2-tetramethylpropyl, a hydroxy group, an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecylphenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methylsulfonyloxy, dodecylsulfonyloxy or 4-methylphenyl-sulfonyloxy; an alkyl- or aryl-sulfamoyl group such as N-butylsulfamoyl or N-4-t-butylphenylsulfamoyl; an alkyl- or aryl-sulfamoylamino group such as N-butyl-sulfamoylamino or N-4-t-butylphenylsulfamoylamino; an alkyl- or aryl-sulfonamido group such as methanesulfonamido, hexadecanesulfonamido or 4-chlorophenylsulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups on the aryl group have 1 to 30 carbon atoms, more preferably 8 to 20 aliphatic carbon atoms. A most preferred substituent is an alkyl group of 12 to 18 aliphatic carbon atoms, such as dodecyl, pentadecyl or octadecyl, or an alkoxy group with 8 to 18 aliphatic carbon atoms such as octyloxy, dodecyloxy and hexadecyloxy, or a halogen such as a chloro group, or an alkoxycarbonyl or alkylsulfonamido group.

In one preferred embodiment, $R_a$ is an alkyl group, $R_b$ is H and L' is —$SO_2$—. One preferred form of cyan dye-forming of formula (IIA) of this embodiment is an "NB coupler" in which $R^4$ and $R^5$ are substituents independently selected such that the coupler is a "NB coupler", as described in EP-A-1 037 103.

In another preferred embodiment $R^5$ is the group

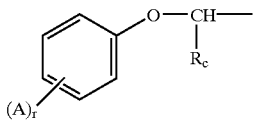

wherein each A is independently a substituent with at least one A being halogen, an alkyl group, hydroxy group, alkyl- or aryl-sulfonamido or -sulfamoyl group, alkoxycarbonyl, carboxylate ester or an alkylcarbonamido group; r is 1 or 2, and $R^c$ is hydrogen or preferably an alkyl group.

Q is hydrogen or halogen or a coupling-off group, suitably a halogen atom or a group linked by an atom of sulfur, oxygen or nitrogen, such as an alkoxy, substituted aryloxy, substituted mercaptotetrazole or thiopropionic acid. Chloro groups are conveniently employed.

Another type of cyan dye-forming coupler that can be practised with the invention is a compound of formula (IIB);

(IIB)

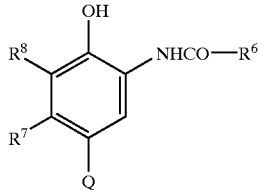

wherein $R^6$ is an unsubstituted or substituted alkyl or aryl group or a 5–10 membered heterocyclic ring which contains one or more heteroatoms selected from nitrogen, oxygen and sulfur, which ring is unsubstituted or substituted;

$R^7$ is an unsubstituted or substituted alkyl group;

$R^8$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted; and Q is hydrogen or halogen or a group which can be split off by the reaction of the coupler with an oxidized colour developing agent.

Referring to formula (IIB), preferably $R^6$ is an unsubstituted or substituted alkyl group, preferably substituted with an aryloxy or an alkyl- or aryl-sulfonyl group, each of which may be further substituted, for example with a substituent as hereinbefore defined for an aryl or heterocyclic ring of $R^4$. When $R^6$ is an aryl or heterocyclic ring it may be substituted, for example with a halogen, cyano or an alkyl group, which may be further substituted.

$R^7$ is an alkyl group which is unsubstituted or substituted, for example with one or more halogen atoms, and is preferably an unsubstituted small chain alkyl group, especially an alkyl group having from one to four carbon atoms.

$R^8$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted. Preferably $R^8$ is halogen, more preferably chlorine, unsubstituted alkyl or an alkyl group substituted, for example with halogen. When $R^8$ is an aryl or heterocyclic ring it may be substituted, for example, with a halogen, cyano or an alkyl group, which may be further substituted. When either $R^6$ and/or $R^8$ is a heterocyclic group this may be, for example, a pyridyl, morpholino, imidazolyl or pyridazolyl group.

Q is as defined for the coupler of formula (IIA) and is preferably chloro, fluoro, substituted aryloxy, substituted mercaptotetrazole or thiopropionic acid, more preferably chloro.

A further type of cyan dye-forming coupler that can be practised with the invention is a compound of formula (IIC):

(IIC)

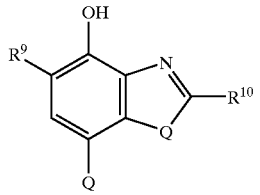

wherein $R^9$ is selected from hydrogen, halogen or an unsubstituted or substituted alkyl, aryl, alkyl- or aryl-amido, alkyl- or aryl-sulfonamido or alkyl- or aryl-ureido group, $R^{10}$ is selected from an unsubstituted or substituted alkyl, aryl, amino, alkoxy, alkoxycarbonyl, alkyl- or aryl-amido, alkyl- or aryl-sulfonamido or alkyl- or aryl-ureido group; and Q is hydrogen or halogen or a group which can be split off by the reaction of the coupler with an oxidized colour developing agent.

With reference to formula (IIC), preferably $R^9$ is hydrogen, an aryl group substituted with one or more halogen atoms, an alkylamido, substituted arylamido or arylureido group. $R^{10}$ is preferably an alkyl group, preferably substituted with an aryloxy or alkyl- or aryl-sulfonyl group, which may be further substituted, or an alkylamido or alkoxycarbonyl group.

The presence or absence of such groups determines the chemical equivalency of the coupler, i.e. whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation and colour correction.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio and arylazo. These coupling-off groups are described in the art, for example, in U.S. Pat. Nos. 2,455,169, 3,227,551, 3,432,521, 3,467,563, 3,617,291, 3,880,661, 4,052,212 and 4,134,766; and in UK Patent Nos. and published applications 1,466,728, 1,531,927, 1,533,039, 2,066,755A and 2,017,704A, the disclosures of which are incorporated herein by reference. Halogen, alkoxy and aryloxy groups are most suitable.

Examples of suitable coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

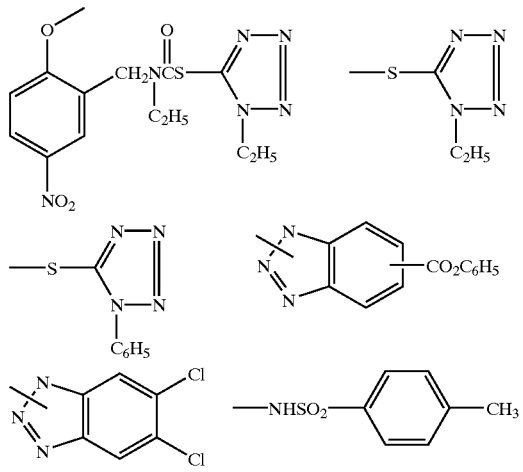

-continued

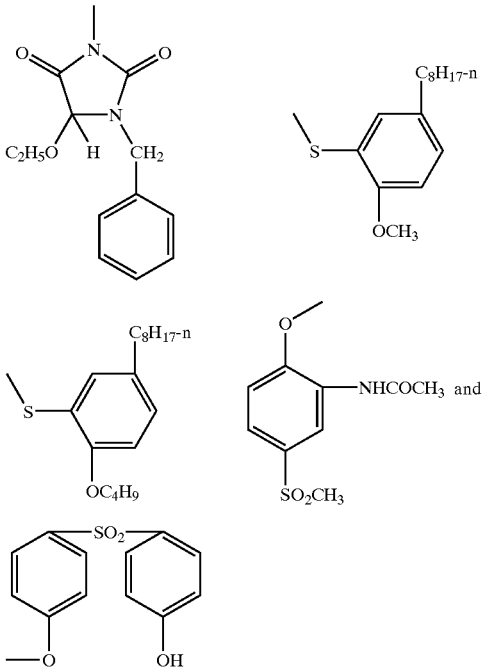

Typically the coupling-off group is a chlorine atom, hydrogen or a p-methoxy-phenoxy group.

It is important that the substituent groups $R^a$–$R^d$, $R^4$–$R^{10}$ and Q are selected so as to adequately ballast the coupler and the resulting dye in the organic solvent in which the coupler is dispersed. The ballasting may be accomplished by providing hydrophobic substituent groups in one or more of these substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of these substituent groups in the couplers for use in the invention are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. Since in a preferred embodiment of the invention $R^7$ in formula (IIB) is a small alkyl group, the ballast in formula (IIB) would be primarily located in $R^6$, $R^8$ and Q. Furthermore, even if the coupling-off group Q contains a ballast it is often necessary to ballast the other substituents as well, since Q is eliminated from the molecule upon coupling.

The following examples further illustrate couplers that may be used in the invention. It is not to be construed that the present invention is limited to these examples.

Compounds of formula (II)
Compounds of formula (IIA)

| —Q | —$R^4$ | $R^5$— | |
|---|---|---|---|
| —Cl | 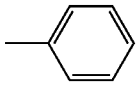 | 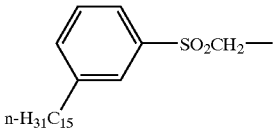 | AC1 |
| —Cl | 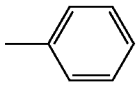 | 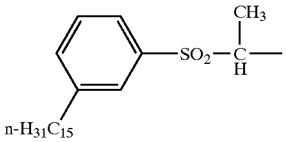 | AC2 |
| —Cl | 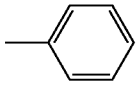 | 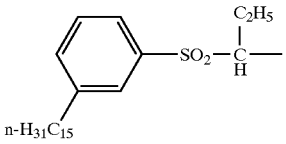 | AC3 |
| —Cl | 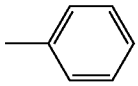 | 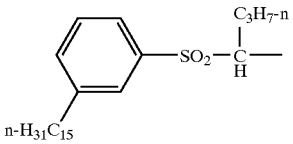 | AC4 |
| —H | 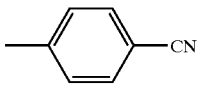 | 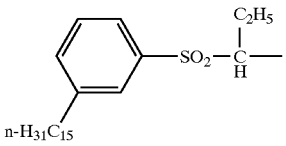 | AC5 |

-continued
| | Compounds of formula (II)<br>Compounds of formula (IIA) | | |
|---|---|---|---|
| —Q | —$R^4$ | $R^5$— | |
| —Cl | 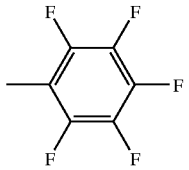 | 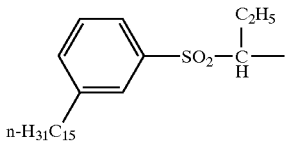 | AC6 |
| —Cl | 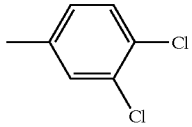 | 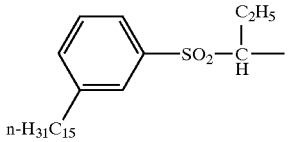 | AC7 |
| —Cl | 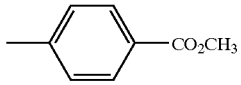 | 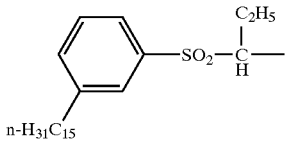 | AC8 |
| —H | 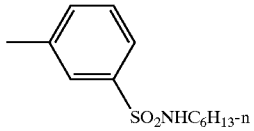 | 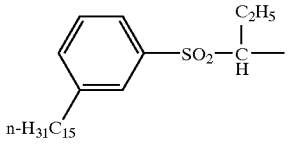 | AC9 |
| —H | 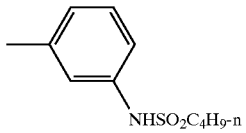 | 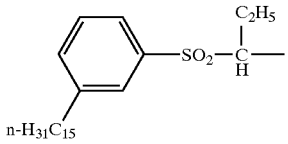 | AC10 |
| —H | 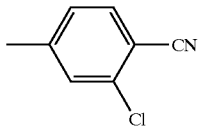 | 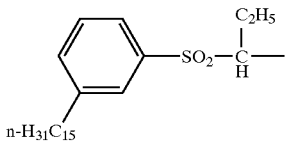 | AC11 |
| —H | —$C_3F_7$-n | 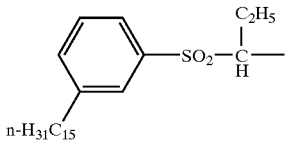 | AC12 |
| —Cl | 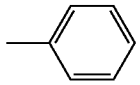 | 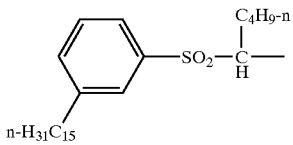 | AC13 |
| —Cl | 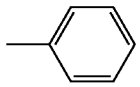 | 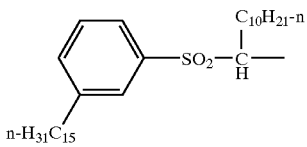 | AC14 |

-continued
Compounds of formula (II)
Compounds of formula (IIA)
| —Q | —$R^4$ | $R^5$— | |
|---|---|---|---|
| —Cl | 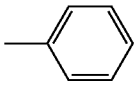 | 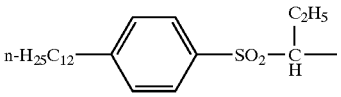 | AC15 |
| 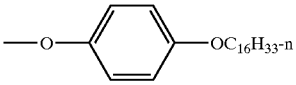 | 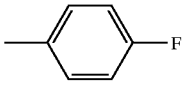 | 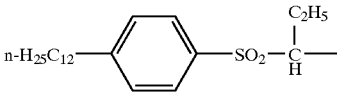 | AC16 |
| —F | —$C_8H_{17}$-n | 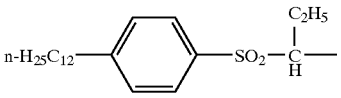 | AC17 |
| —H | 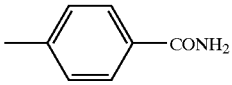 | 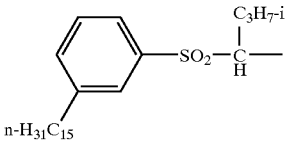 | AC18 |
| 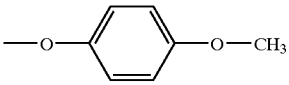 | 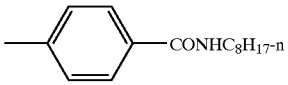 | 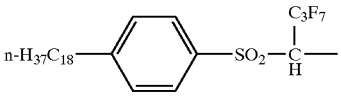 | AC19 |
| —Cl | 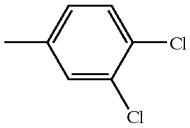 | 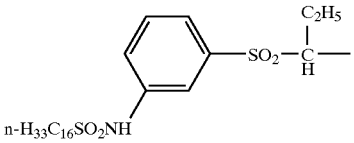 | AC20 |
| 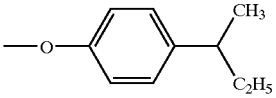 | 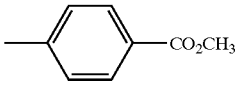 | 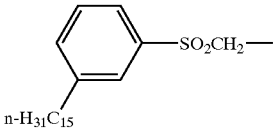 | AC21 |
| —F | 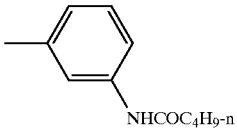 | 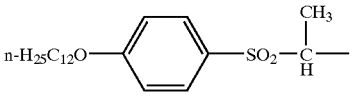 | AC22 |
| —Cl | 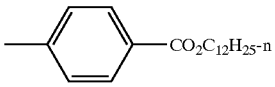 | 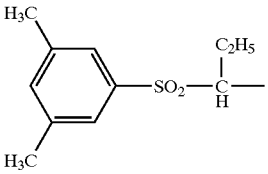 | AC23 |
| —Cl | 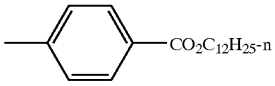 | 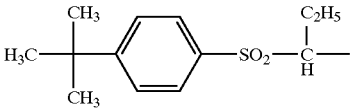 | AC24 |
| —Cl | 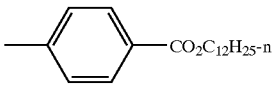 | 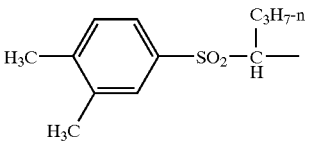 | AC25 |

-continued
| Compounds of formula (II) Compounds of formula (IIA) | | | |
|---|---|---|---|
| —Q | —$R^4$ | $R^5$— | |
| 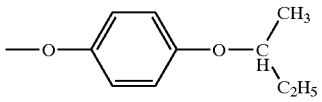 | —$C_3F_7$ | 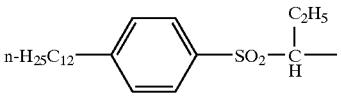 | AC26 |
| —Cl | 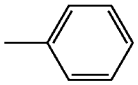 | 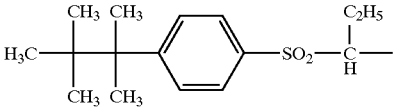 | AC27 |
| 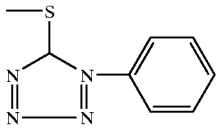 | 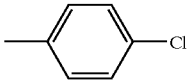 | 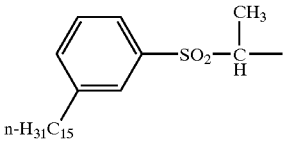 | AC28 |
| 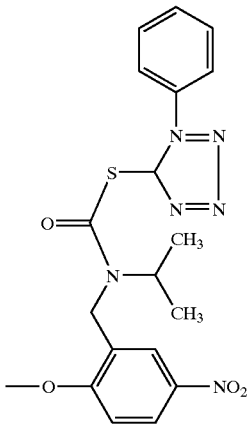 | —$C_4H_9$-n | 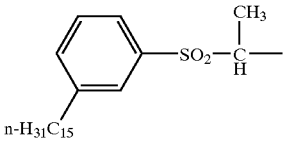 | AC29 |
| 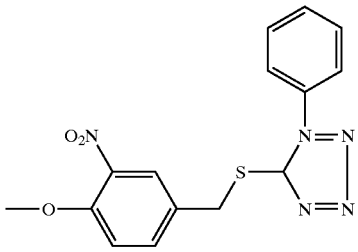 | 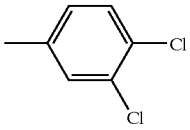 | 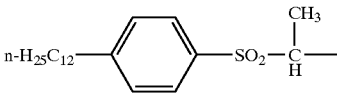 | AC30 |
| —Cl | 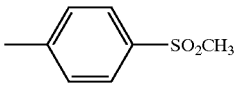 | 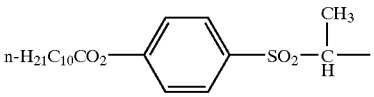 | AC31 |
| —Cl | 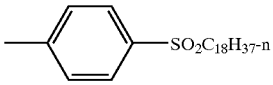 | 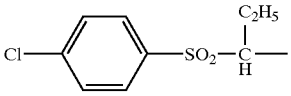 | AC32 |
| —Cl | 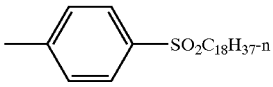 | 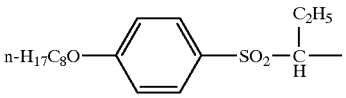 | AC33 |

-continued
Compounds of formula (II)
Compounds of formula (IIA)
| —Q | —R[4] | R[5]— | |
|---|---|---|---|
| —Cl | 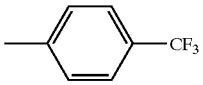 | 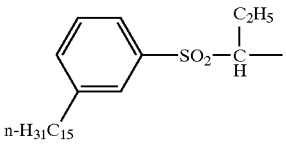 | AC34 |
| Cl | 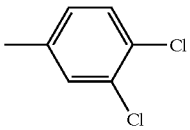 | 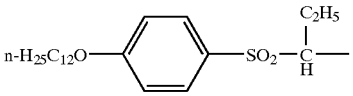 | AC35 |
| Cl | 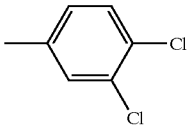 | 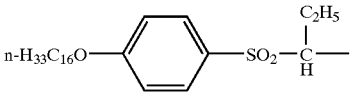 | AC36 |
| Cl | 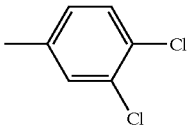 | 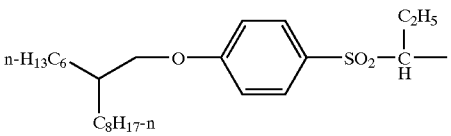 | AC37 |
| —Cl | 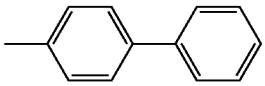 | 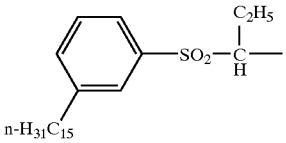 | AC38 |
| —Cl | 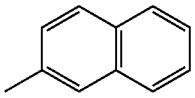 | 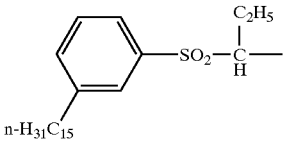 | AC39 |
| —Cl | 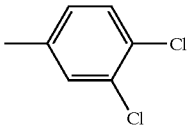 | 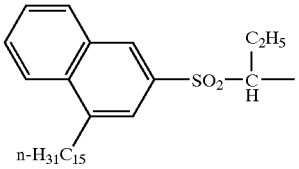 | AC40 |
| —Cl | 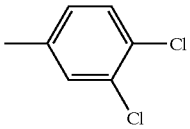 | 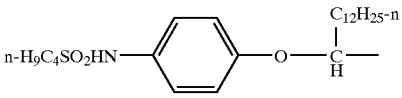 | AC41 |
| —Cl | 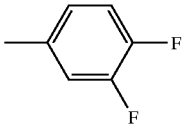 | 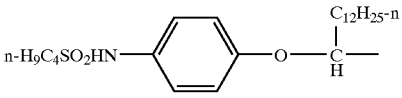 | AC42 |
| —Cl | 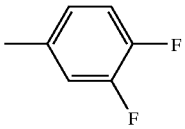 | 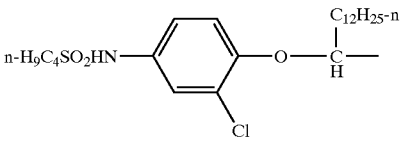 | AC43 |

-continued
| —Q | Compounds of formula (II) Compounds of formula (IIA) —$R^4$ | $R^5$— | |
|---|---|---|---|
| —Cl | 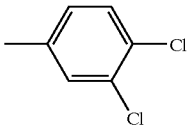 | 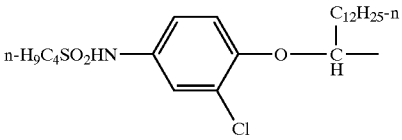 | AC44 |
| —Cl | 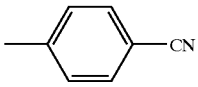 | 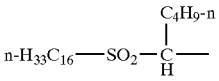 | AC45 |
| —Cl | 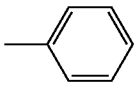 | 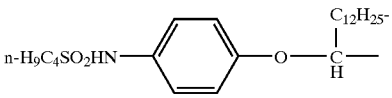 | AC46 |
| —Cl | 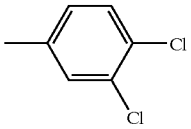 | 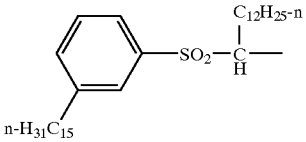 | AC47 |
| —F | 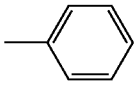 | 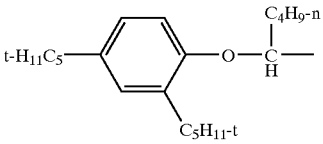 | AC48 |
| —Cl | 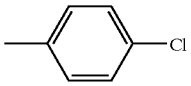 | 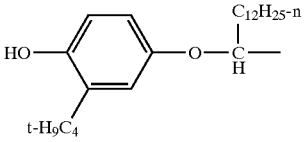 | AC49 |
| 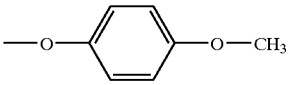 | 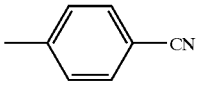 | 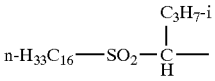 | AC50 |
| —Cl | 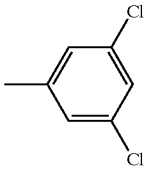 | 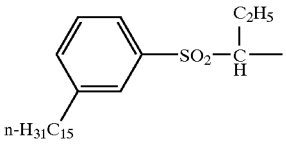 | AC51 |
| —Cl | 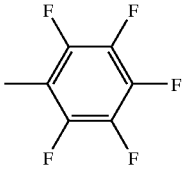 | 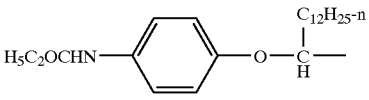 | AC52 |
| —Cl | —$C_3F_7$-n | 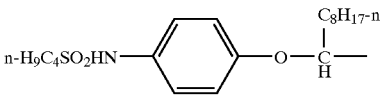 | AC53 |

-continued
| | Compounds of formula (II)<br>Compounds of formula (IIA) | | |
|---|---|---|---|
| —Q | —$R^4$ | $R^5$— | |
| —F | 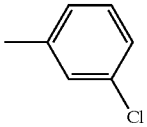 | 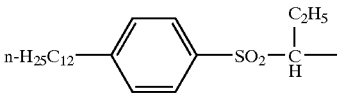 | AC54 |
| —$OCH_3$ | 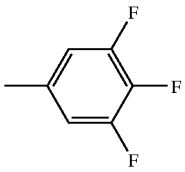 | 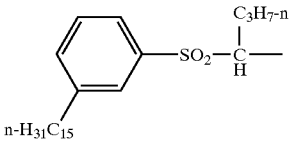 | AC55 |
| —Cl | 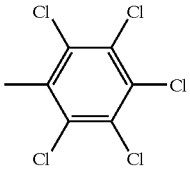 | 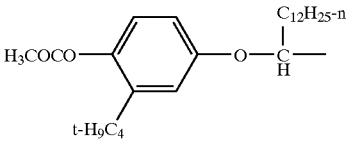 | AC56 |
| —Cl | 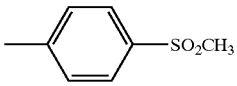 | 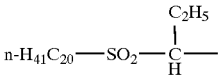 | AC57 |
| —Cl | 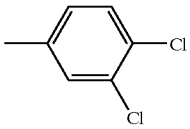 | 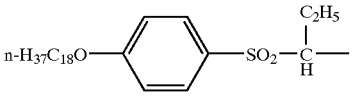 | AC58 |
| —H | 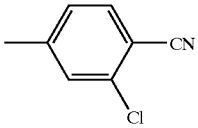 | 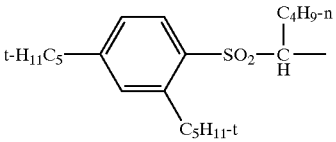 | AC59 |
| —Cl | 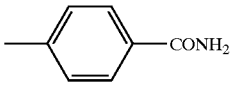 | 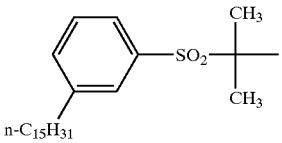 | AC60 |
| —H | 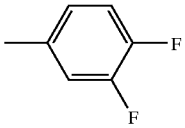 | 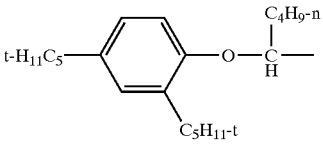 | AC61 |
| —H | 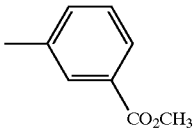 | 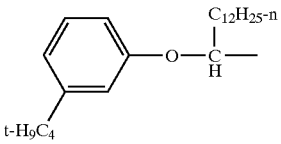 | AC62 |

-continued
Compounds of formula (II)
Compounds of formula (IIA)
| —Q | —R[4] | R[5]— | |
|---|---|---|---|
| —Cl | 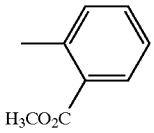 | 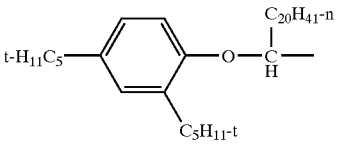 | AC63 |
| 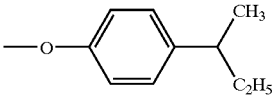 | 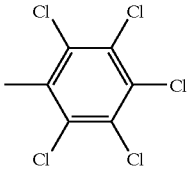 | 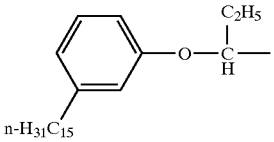 | AC64 |
| —Cl | 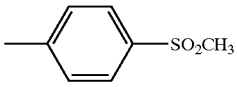 | 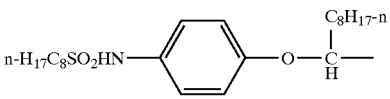 | AC65 |
| —Cl | 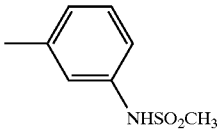 | 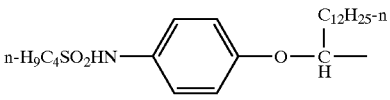 | AC66 |
| —Cl | 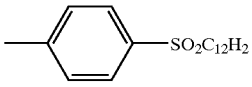 | 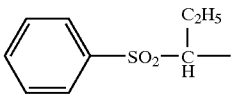 | AC67 |
| 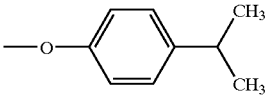 | 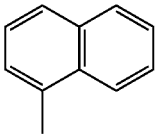 | 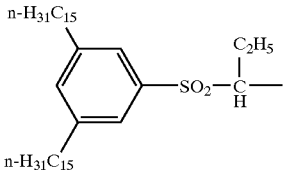 | AC68 |
| —$SCH_2CH_2CO_2H$ | 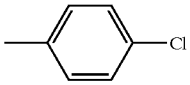 | 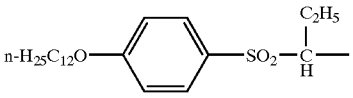 | AC69 |
| —Cl | 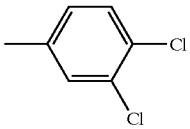 | 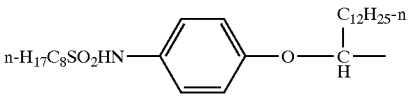 | AC70 |
| —Cl | 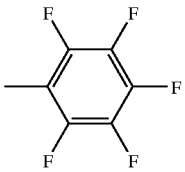 | 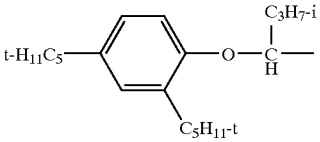 | AC71 |
| —Cl | 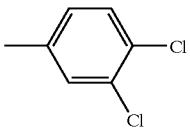 | 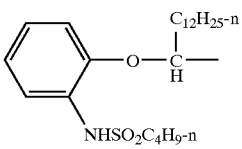 | AC72 |

-continued
Compounds of formula (II)
Compounds of formula (IIA)
| —Q | —$R^4$ | $R^5$— | |
|---|---|---|---|
| —Cl | 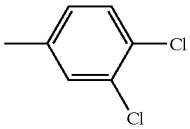 | 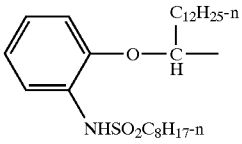 | AC73 |
| —Cl | 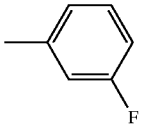 | 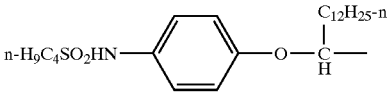 | AC74 |
| —Cl | 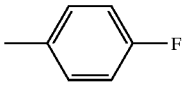 | 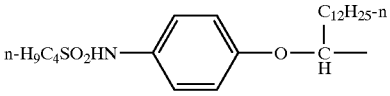 | AC75 |
| —Cl | 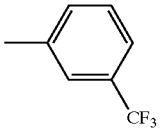 | 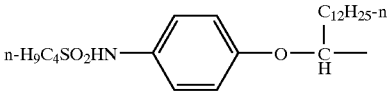 | AC76 |
| —Cl | 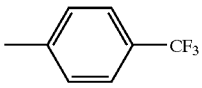 | 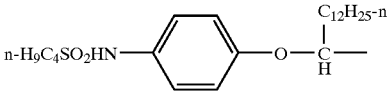 | AC77 |
| —Cl | 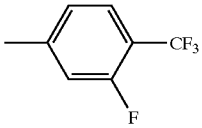 | 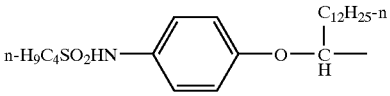 | AC78 |
| —Cl | 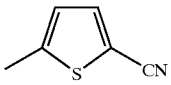 | 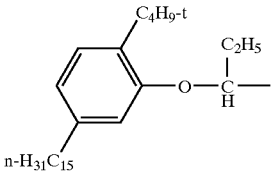 | AC79 |
| —F | 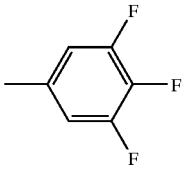 | 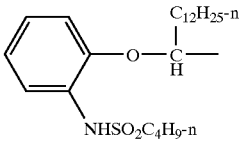 | AC80 |
| —Cl | 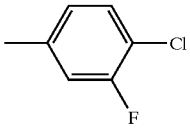 | 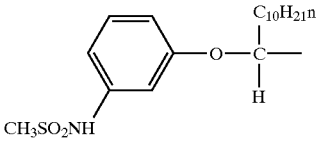 | AC81 |
| —Cl | 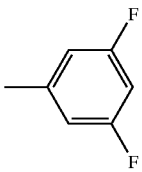 | 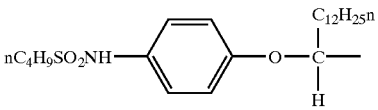 | AC82 |

-continued
Compounds of formula (II)
Compounds of formula (IIA)
| —Q | —R$^4$ | R$^5$— | |
|---|---|---|---|
| 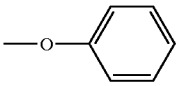 | 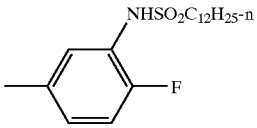 | 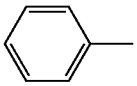 | AC83 |
| 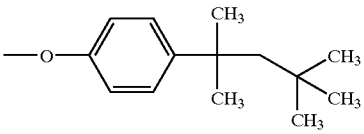 | 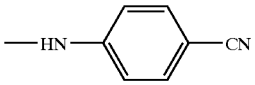 | 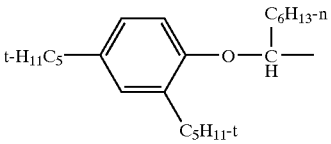 | AC84 |
| —Cl | 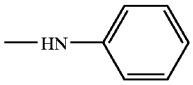 | 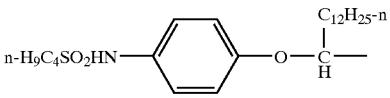 | AC85 |
Compounds of formula (IIB)
| —Q | —R$^6$ | R$^7$— | R$^8$— | |
|---|---|---|---|---|
| —Cl | 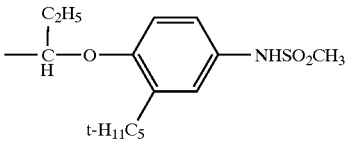 | $H_5C_2$— | Cl— | BC1 |
| —Cl | 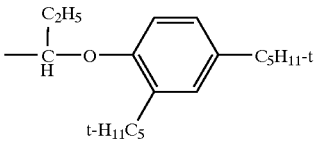 | $H_3C$— | Cl— | BC2 |
| —Cl | 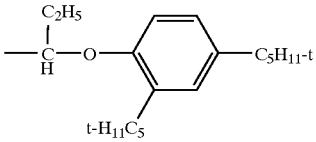 | $H_5C_2$— | Cl— | BC3 |
| —Cl | 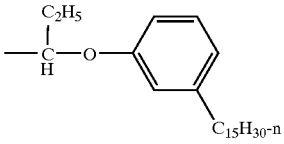 | $H_5C_2$— | Cl— | BC4 |
| —Cl | —$C_{15}H_{31}$-n | $H_5C_2$— | Cl— | BC5 |
| —Cl | 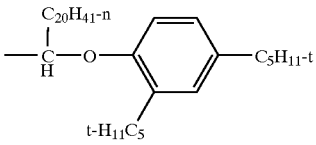 | $H_5C_2$— | Cl— | BC6 |

-continued
Compounds of formula (IIB)
| —Q | —$R^6$ | $R^7$— | $R^8$— | |
|---|---|---|---|---|
| —Cl | 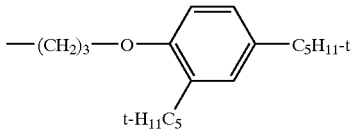 | n-$H_7C_3$— | Cl— | BC7 |
| —Cl | 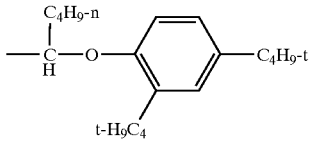 | $H_5C_2$— | Cl— | BC8 |
| —F | 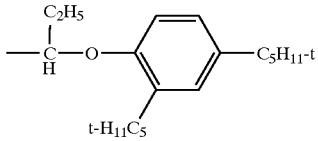 | n-$H_9C_4$— | Cl— | BC9 |
| —Cl | 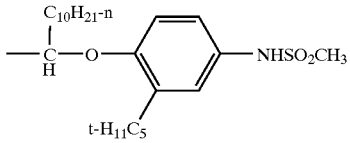 | $H_5C_2$— | Cl— | BC10 |
| —H | 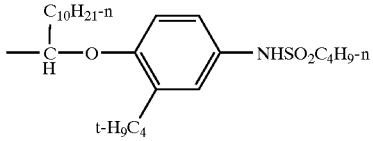 | $H_5C_2$— | Cl— | BC11 |
| Cl— | 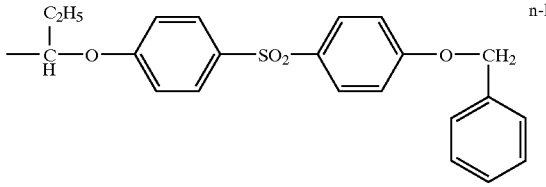 | n-$H_9C_4$— | $H_3C$— | BC12 |
| 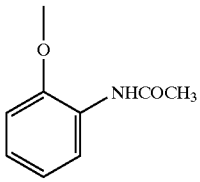 | 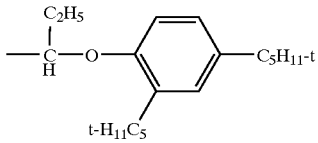 | t-$H_9C_4$— | H— | BC13 |
| —$S(CH_2)_2CO_2H$ | 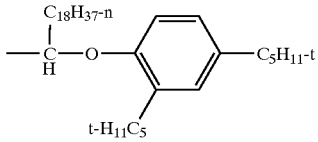 | $H_5C_2$— | Cl— | BC14 |
| —F | 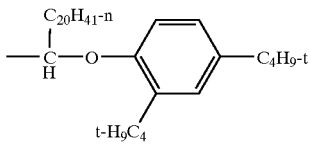 | $H_5C_2$— | Cl— | BC15 |

-continued
Compounds of formula (IIB)
| —Q | —R$^6$ | R$^7$— | R$^8$— | |
|---|---|---|---|---|
| —Cl | 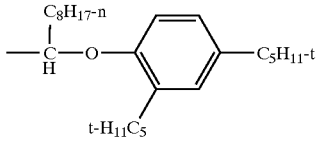 | $H_3C$— | Cl— | BC16 |
| —F | 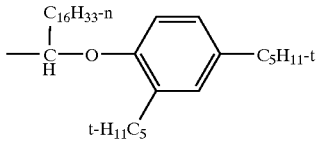 | $H_3C$— | F— | BC17 |
| 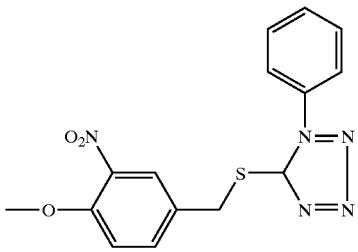 | 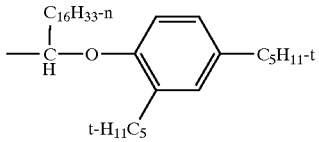 | $H_5C_2$— | F— | BC18 |
| 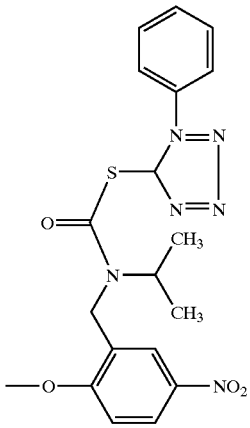 | 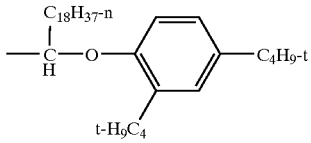 | $H_3C$— | Cl— | BC19 |
| —Cl | 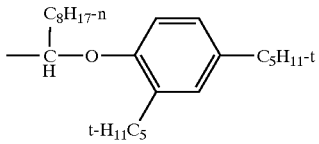 | $H_5C_2$— | Cl— | BC20 |
| —Cl | 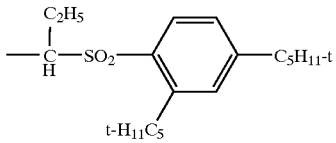 | $H_5C_2$— | Cl— | BC21 |
| —Cl | 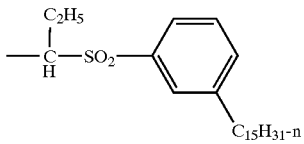 | $H_5C_2$— | Cl— | BC22 |

-continued
Compounds of formula (IIB)
| —Q | —R$^6$ | R$^7$— | R$^8$— | |
|---|---|---|---|---|
| —Cl | 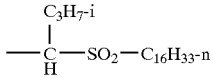 | $H_5C_2$— | Cl— | BC23 |
| —Cl | 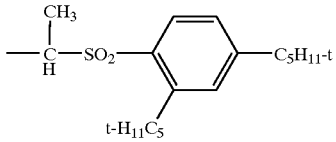 | n-$H_7C_3$— | Cl— | BC24 |
| —F | 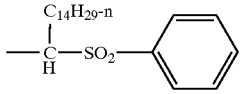 | $H_5C_2$— | F— | BC25 |
Structures for II(C)
| —Q | R$^9$— | —R$^{10}$ | |
|---|---|---|---|
| —H | H— | 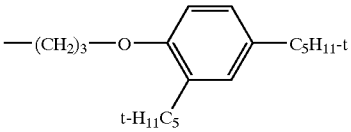 | CC1 |
| —Cl | $CH_3$—CO—HN— | 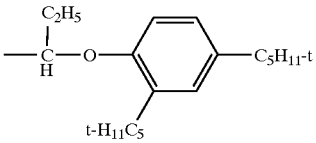 | CC2 |
| —Cl | 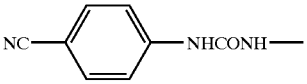 | 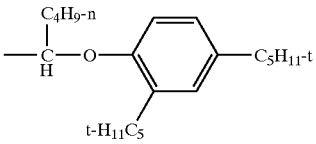 | CC3 |
| —S($CH_2$)$_2$$CO_2$H | 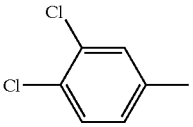 | 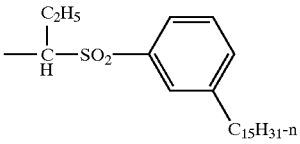 | CC4 |
| —Cl | 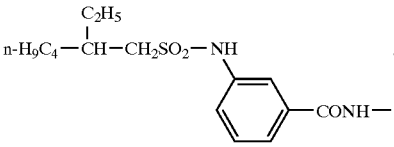 | 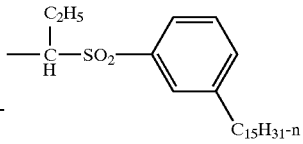 | CC5 |
| —F | 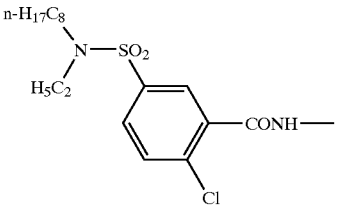 | 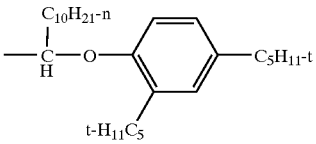 | CC6 |

-continued

Structures for II(C)

| —Q | $R^9$— | —$R^{10}$ | |
|---|---|---|---|
| 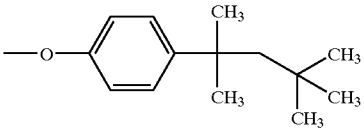 | 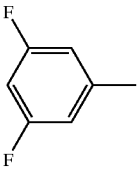 | 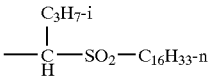 | CC7 |
| Cl— | 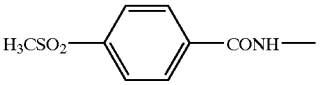 | —NHCO—$C_{15}H_{31}$-n | CC8 |
| 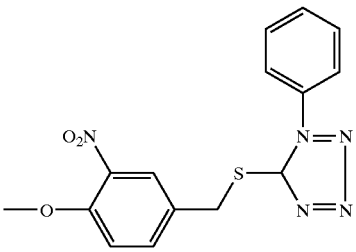 | H— | —$C_{18}H_{37}$-n | CC9 |
| Cl— | 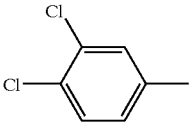 | —$CO_2C_{18}H_{37}$-n | CC10 |

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy and 2-dodecyl-oxyethoxy; aryl such as phenyl, 4-t-butyl-phenyl, 2,4,6-trimethylphenyl, naphthyl; aryloxy, such as phenoxy, 2-methylphenoxy, alpha- or beta-naphthyloxy and 4-tolyloxy; carbonamido, such as acetamido, benzamido, butyramido, tetradecanamido, alpha-(2,4-di-t-pentylphenoxy)acetamido, alpha-(2,4-di-t-pentyl-phenoxy) butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3 dodecyl-2,5-dioxo-1-imidazolyl and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecyl-ureido, N-hexadecylureido, N,N-dioctadecylureido, N,N-dioctyl-N'-ethylureido, N-phenylureido, N,N-di-phenylureido, N-phenyl-N-p-toluylureido, N-(m-hexa-decylphenyl)ureido, N,N-(2,5-di-t-pentylphenyl)-N'-ethylureido and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino and hexadecylsulfonamido; sulfamoyl, such as N-methyl-sulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl and N-dodecylsulfamoyl; carbamoyl, such as N-methylcarbamoyl, N,N-dibutyl-carbamoyl, N-octadecylcarbamoyl, N-[4-(2,4-di-t-pentylphenoxy)butyl]-carbamoyl, N-methyl-N-tetradecylcarbamoyl and N,N-di-octylcarbamoyl; acyl, such as acetyl, (2,4-di-t-amylphenoxy)acetyl, phenoxycarbonyl, p-dodecyloxy-phenoxycarbonyl, methoxycarbonyl, butoxycarbonyl, tetradecyloxycarbonyl, ethoxycarbonyl, benzyloxycarbonyl, 3-pentadecyloxycarbonyl and dodecyl-oxycarbonyl; sulfonyl, such as methoxysulfonyl, octyloxysulfonyl, tetradecyl-oxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl and p-toluylsulfonyl; sulfonyloxy, such as dodecylsulfonyloxy and hexadecyl-sulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl and p-toluylsulfinyl; thio, such as ethylthio, octylthio, benzylthio, tetradecylthio, 2-(2,4-di-t-pentylphenoxy)-ethylthio, phenylthio, 2-butoxy-5-t-octylphenylthio and p-tolylthio; acyloxy, such as acetyloxy, benzoyloxy, octadecanoyloxy, p-dodecylamidobenzoyloxy, N-phenylcarbamoyloxy, N-ethylcarbamoyloxy and cyclohexylcarbonyloxy; amino, such as phenylanilino, 2-chloroanilino, diethylamino and dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido and sulfamoyl groups wherein the substituents typically contain 1 to 42 carbon atoms. Such substituents can also be further substituted.

To increase the light stability of a coating a light stabilizer is added. A class of stabilizers frequently used is one of UV absorbers, especially benzotriazoles, that protect the material by absorbing damaging radiation. Another useful group of UV absorbers are the triphenyl-s-triazines, as described e.g. in the following: U.S. Pat. Nos. 3,118,887 and 5,461,151, DE 2,113,833 and EP-A-0 704 437 and in particular the hydroxyphenyltriazine stabilizers described in GB-A-2 317 174.

As used herein the term 'UV absorber' is used to denote a compound that is often used as a light stabilizer (via filtration of UV light) but in this invention can act as both dark and light stabilizer. In particular the UV absorber is preferably a benzotriazole of formula (III):

(III)

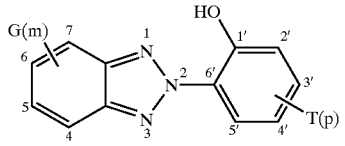

wherein each G is an independently selected substituent and m is 0 to 4; and each T is an independently selected substituent and p is 0 to 4.

Suitably each G is independently selected from hydrogen, halogen, nitro and a substituent selected from the group consisting of unsubstituted or substituted alkyl, aryl, alkoxy, aryloxy, acyloxy, alkyl- or aryl-thio, mono- or di-alkylamino, acylamino, alkoxycarbonyl and a 5-membered or 6-membered heterocyclic group containing a nitrogen, oxygen or sulfur atom, and m is 0 to 4.

Furthermore each T is suitably independently selected from hydrogen, halogen and a substituent selected from the group consisting of unsubstituted or substituted alkyl, aryl, alkoxy, aryloxy, acyloxy, alkyl- or aryl-thio, mono- or di-alkylamino, acylamino and a 5-membered or 6-membered heterocyclic group containing a nitrogen, oxygen or sulfur atom, and p is 0 to 4.

More preferably the 5-position and/or 6-position of the benzotriazole ring is unsubstituted or substituted with chlorine, a nitro group, an unsubstituted alkyl, alkoxy or an alkoxycarbonyl group. Furthermore the 3' and 5' positions of the phenyl ring are preferably unsubstituted and the 2'-and/or 4'-positions are preferably substituted with an unsubstituted or substituted alkyl, alkoxy or aryloxy group, especially a branched alkyl group, such as a t-butyl, t-pentyl or 2-ethylhexyl group, or an alkyl group substituted, for example, with an alkoxycarbonyl or substituted amino group. More preferably the ring is di-substituted at the 2'-and 4'-positions.

The following UV absorbers further illustrate the invention. It is not to be construed that the present invention is limited to these examples.

UV1

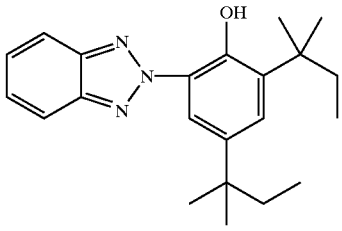

UV2

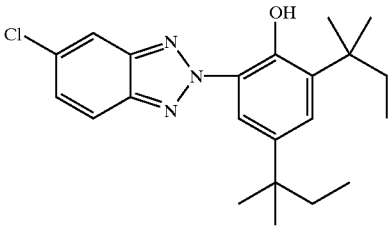

-continued
UV3
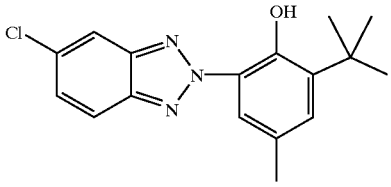
UV4
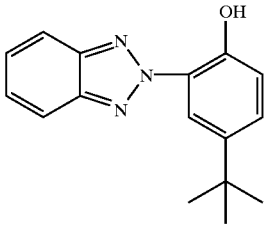
UV5
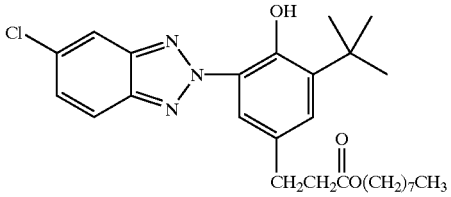
UV6
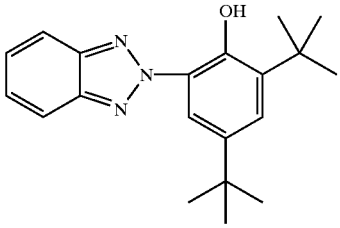
UV7
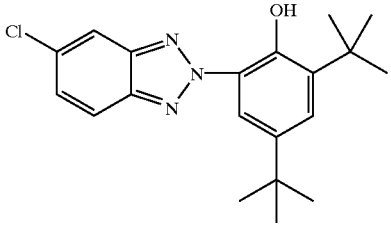
UV8
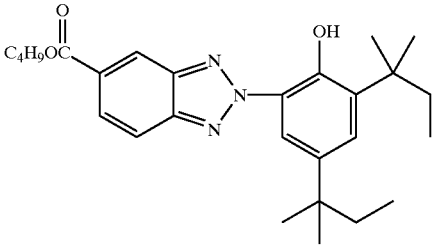
UV9
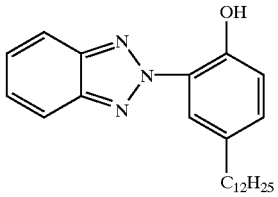
UV10
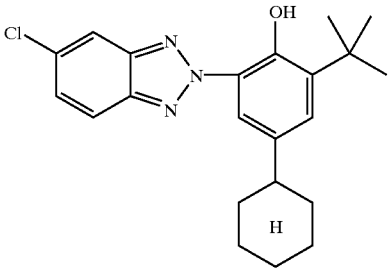
UV11
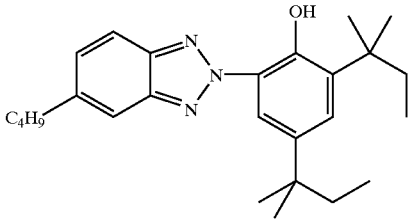
UV12
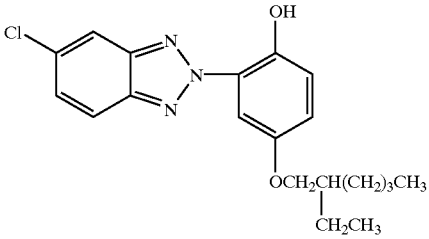
UV13
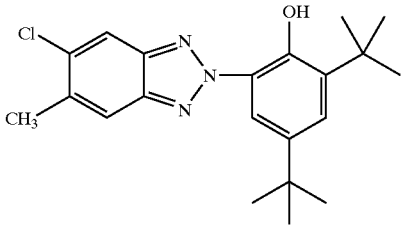
UV14
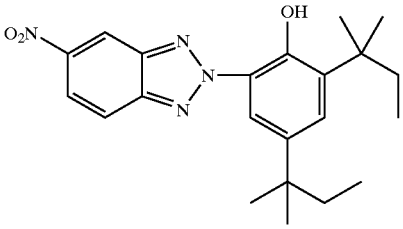

-continued
UV15
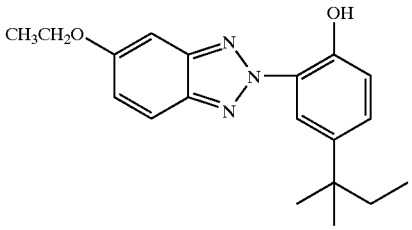
UV16
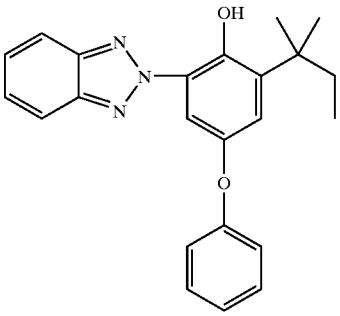
UV17
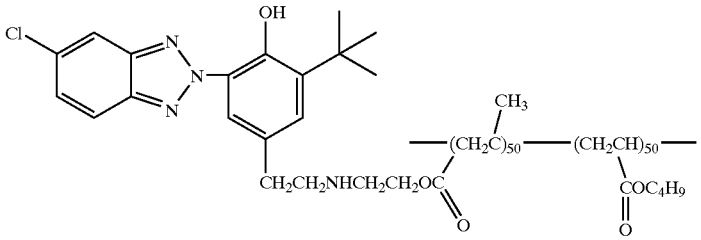
UV18
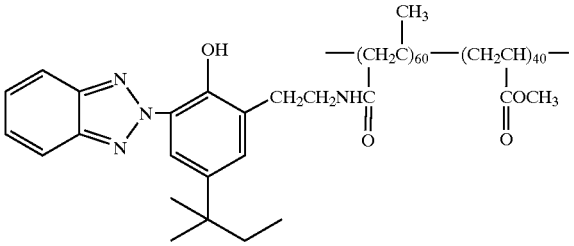
UV19
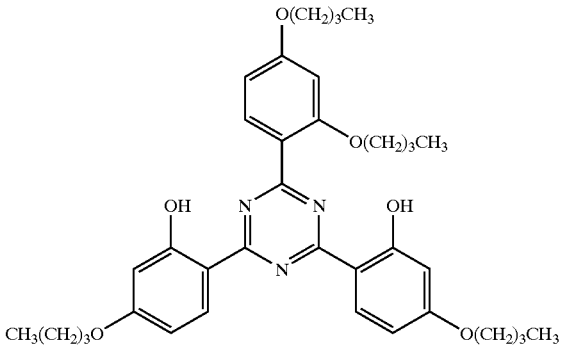
UV20
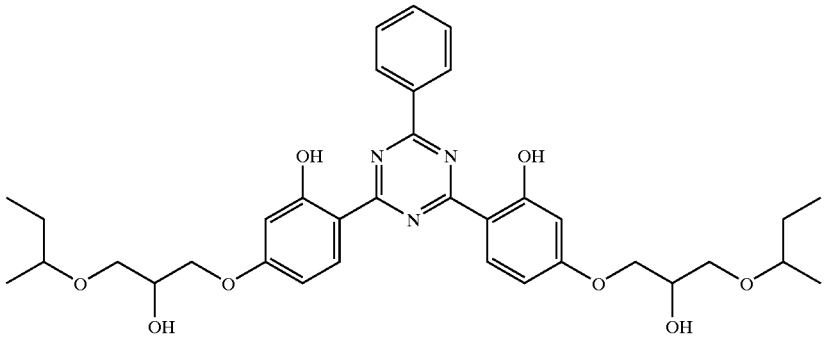

-continued

UV21

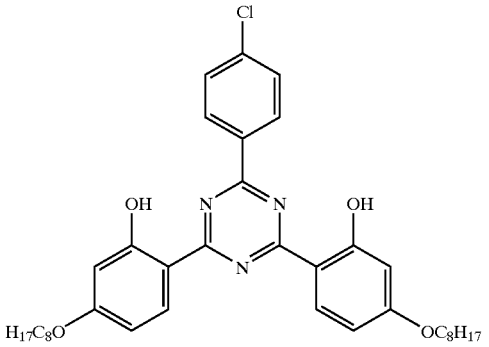

UV22

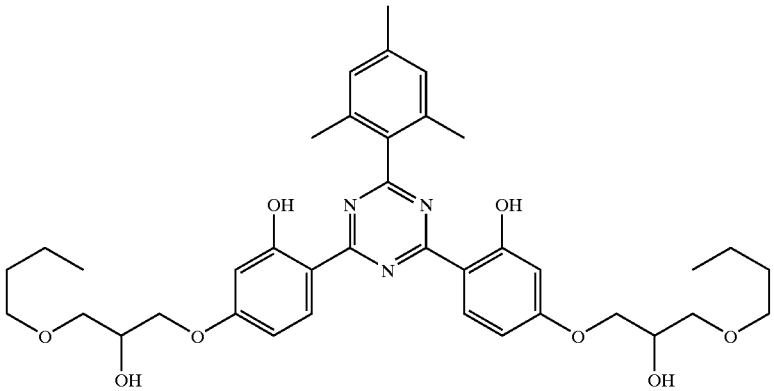

UV23

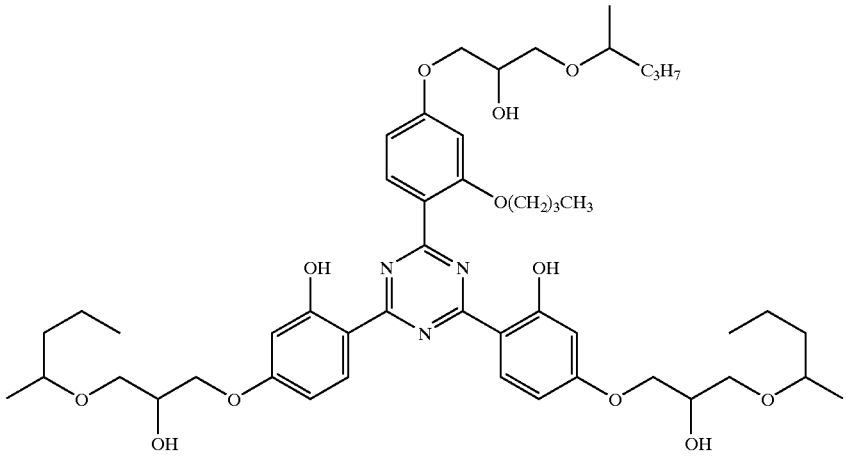

Embodiments of the invention enable lower amounts of coupler and silver to be used by improving the efficiency with which oxidized colour developer reacts with the coupler to form dye. They further exhibit reduction of low unwanted side-band absorption, especially unwanted green absorption, providing a colour record having improved stability to light, heat and humidity and improved hue.

The dispersion of the coupler(s), UV absorber and stabilizer for use in the invention can be incorporated into the photographic element as emulsified photographic dispersions, prepared by dissolving the materials in one or more high-boiling permanent organic solvents, with or without a low-boiling or partially water-soluble auxiliary organic solvent. A blend of permanent solvents may be advantageous to optimise the desired features, such as solubility, dye hue, thermal or light stability or the coupling reactivity of the dispersions.

The resulting organic solution may then be mixed with an aqueous gelatin solution and the mixture passed through a mechanical mixing device suitable for high-shear or turbulent mixing generally suitable for preparing photographic emulsified dispersions, as described in EP-A-1 037 103, incorporated herein by reference. The dispersion particles preferably have an average particle size of less than 2 $\mu$m, generally from about 0.02 to 2 $\mu$m, more preferably from about 0.02 to 0.5 $\mu$m, especially from about 0.02 to 0.3 $\mu$m. These methods are described in detail in U.S. Pat. Nos. 2,322,027, 2,787,544, 2,801,170, 2,801,171, 2,949,360 and 3,396,027, the disclosures of which are incorporated by reference herein.

The aqueous phase of the coupler dispersions for use in the invention preferably comprises gelatin as a hydrophilic colloid. This may be gelatin or a modified gelatin such as acetylated gelatin, phthalated gelatin or oxidized gelatin.

Gelatin may be base-processed, such as lime-processed gelatin, or may be acid-processed, such as acid-processed ossein gelatin. Other hydrophilic colloids may also be used, such as a water-soluble polymer or copolymer including, but not limited to poly(vinyl alcohol), partially hydrolyzed poly(vinyl acetate-co-vinyl alcohol), hydroxyethyl cellulose, poly(acrylic acid), poly(1-vinylpyrrolidone), poly (sodium styrene sulfonate), poly(2-acrylamido-2-methane sulfonic acid) and polyacrylamide. Copolymers of these polymers with hydrophobic monomers may also be used.

A surfactant may be present in either the aqueous phase or the organic phase or the dispersions can be prepared without any surfactant present. Surfactants may be cationic, anionic, zwitterionic or non-ionic. Ratios of surfactant to liquid organic solution typically are in the range of 0.5 to 25wt. % for forming small particle photographic dispersions. In a preferred embodiment of the invention, an anionic surfactant is contained in the aqueous gelatin solution. Particularly preferred surfactants which are employed in the present invention include an alkali metal salt of an alkarylene sulfonic acid, such as the sodium salt of dodecyl benzene sulfonic acid or sodium salts of isopropylnaphthalene sulfonic acids, such as mixtures of di-isopropyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis (2-ethylhexyl) succinic sulfonate.

Aqueous dispersions of high-boiling solvents can be prepared similarly to the coupler dispersion(s), e.g. by adding the solvent to an aqueous medium and subjecting such mixture to high shear or turbulent mixing as described above. The aqueous medium is preferably a gelatin solution, and surfactants may also be used as described above. Additionally, a hydrophobic additive may be dissolved in the solvent to prevent particle growth as described in U.S. Pat. No. 5,468,604, the disclosure of which is incorporated by reference. The mixture is then passed through a mechanical mixing device such as a colloid mill, homogenizer, microfluidizer, high-speed mixer or ultrasonic dispersing apparatus to form small particles of the organic solvent suspended in the aqueous phase. These methods are described in detail in the aforementioned references on dispersion making.

An aqueous coating solution in accordance with the present invention may then be prepared by combining the coupler dispersion(s) with the separate dispersion of the high-boiling organic solvent. Other ingredients may also be contained in this solution such as silver halide emulsions, dispersions or solutions of other photographically useful compounds, additional gelatin, or acids and bases to adjust the pH. These ingredients may then be mixed with a mechanical device at an elevated temperature (e.g. 30 to 50C.) for a short period of time (e.g. 5 min to 4 h) prior to coating.

The materials for use in the invention can be used in any of the ways and in any of the combinations known in the art. Typically, the materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized colour developing agent. Thus, as used herein, the term "associated" signifies that the compound is in the silver halide emulsion layer or in an adjacent location where, during processing, it is capable of reacting with silver halide development products.

Suitable laydowns of total coupler are from about 0.01 mmol/$m^2$ to about 1.5 mmol/$m^2$, preferably from about 0.15 mmol/$m^2$ to about 1 mmol/$m^2$ to more preferably from about 0.20 mmol/$m^2$to about 0.70 mmol/$m^2$. The ratio of either stabilizer of formula (I) or UV absorber to total coupler is from about 0.01:1 to about 4:1, preferably from about 0.1:1 to about 2:1, more preferably from about 0.5:1 to about 2:1. The ratio of solvent to total coupler is from about 0.2:1 to about 4:1, preferably from about 0.5:1 to about 4:1, more preferably from about 0.5:1 to about 2:1.

The photographic elements comprising coupler dispersions for use in the invention can be single colour elements or multicolour elements. Multicolour elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolour photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler.

The element can be employed with a reflective support, as described in U.S. Pat. No. 5,866,282. The element can contain additional layers, such as filter layers, interlayers, overcoat layers and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230 provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. colour negative, reversal or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials and physical property modifying addenda such as hardeners, coating aids, plasticizers, lubricants and matting agents are described, for example, in Sections II and VI through VIII. Colour materials are described in Sections X through XIII. Scan facilitating is described in Section XIV. Supports, exposure, development systems and processing methods and agents are described in Sections XV to XX. Certain desirable photographic elements and processing steps, particularly those useful in conjunction with colour reflective prints, are described in *Research Disclosure*, Item 37038, February 1995. U.S. Pat. No. 5,558,980 discloses loaded latex compositions, such as poly- and t-butylacrylamides which can be incorporated into any photographic coating in any layer to provide extra dye stability.

Couplers that form cyan dyes upon reaction with oxidized colour developing agents are typically phenols, naphthols or pyrazoloazoles, described in such representative patents and publications as U.S. Pat. Nos. 2,367,531, 2,423,730, 2,474,293, 2,772,162, 2,895,826, 3,002,836, 3,034,892, 3,041,236, 4,333,999 and 4,883,746, European Patent Application Nos. 0 544 322, 0 556 700,0 556 777, 0 565 096, 0 570 006 and 0 574 948 and "Farbkuppler-eine Literature Übersicht," published in Agfa Mitteilungen, Band III, pp. 156–175 (1961).

Typical cyan couplers are represented by the following formulae:

CYAN-1

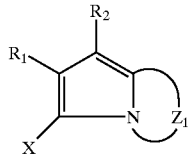

CYAN-2

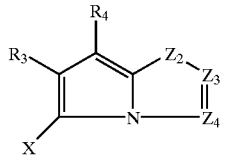

CYAN-3

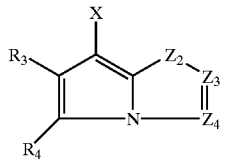

CYAN-4

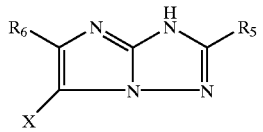

wherein $R_1$, $R_5$ and $R_8$ each represent a hydrogen or a substituent, $R_2$ represents a substituent, $R_3$, $R_4$ and $R_7$ each represent an electron attractive group having a Hammett's substituent constant $s_{para}$ of 0.2 or more and the sum of the $s_{para}$ values of $R_3$ and $R_4$ is 0.65 or more, $R_6$ represents an electron attractive group having a Hammett's substituent constant $s_{para}$ of 0.35 or more, X represents a hydrogen or a coupling-off group, $Z_1$ represents nonmetallic atoms necessary for forming a nitrogen-containing, six-membered, heterocyclic ring which has at least one dissociative group, $Z_2$ represents —C($R_7$)= and —N= and $Z_3$ and $Z_4$ each represent —C($R_8$)= and —N=, or by the formulae:

CYAN-5

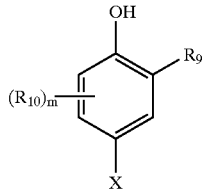

CYAN-6

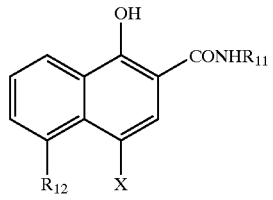

wherein $R_9$ represents a substituent (preferably a carbamoyl, ureido, or carbonamido group), $R_{10}$ represents a substituent (preferably individually selected from halogens, alkyl, and carbonamido groups), $R_{11}$ represents ballast substituent; $R_{12}$ represents a hydrogen or a substituent (preferably a carbonamido or sulfonamido group), X represents a hydrogen or a coupling-off group, and m is an integer from 1–3.

Couplers that form magenta dyes upon reaction with oxidized colour developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654 and "Farbkuppler-eine Literature Übersicht," published in Agfa Mitteilungen, Band III, pp. 126–156 (1961). Preferably such couplers are pyrazolones, pyrazolotriazoles or pyrazolobenzimidazoles that form magenta dyes upon reaction with oxidized colour developing agents.

Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493, 1,252,418, 1,398,979, U.S. Pat. Nos. 4,443,536, 4,514,490, 4,540,654, 4,590,153, 4,665,015, 4,822,730, 4,945,034, 5,017,465 and 5,023,170. Examples of 1H-pyrazolo [1,5-b]-1,2,4-triazoles can be found in European Patent applications 176,804, 177,765, U.S. Pat. Nos. 4,659,652, 5,066,575 and 5,250,400.

Typical pyrazoloazole and pyrazolone couplers are represented by the following formulae:

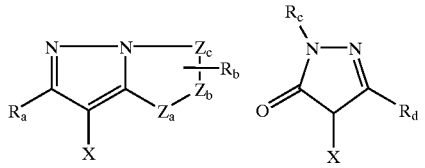

wherein $R_a$ and $R_b$ are independently hydrogen or a substituent, $R_c$ is a substituent (preferably an aryl group), $R_d$ is a substituent (preferably an anilino, carbonamido, ureido, carbamoyl, alkoxy, aryloxycarbonyl, alkoxycarbonyl, or N-heterocyclic group), X is hydrogen or a coupling-off group, and $Z_a$, $Z_b$, and $Z_c$ are independently a substituted methine group, =N—, =C— or —NH—, provided that one of either the $Z_a$–$Z_b$ bond or the $Z_b$–$Z_c$ bond is a double bond and the other is a single bond, and when the $Z_b$–$Z_c$ bond is a carbon-carbon double bond, it may form part of an aromatic ring, and at least one of $Z_a$, $Z_b$, and $Z_c$ is a methine group connected to the group $R_b$.

Specific examples of such couplers are:

M-1

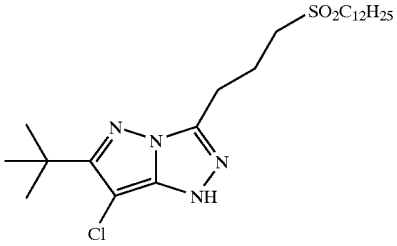

M-2

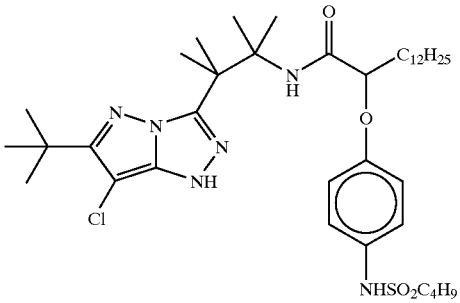

M-3

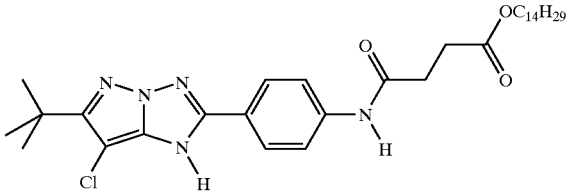

M-4

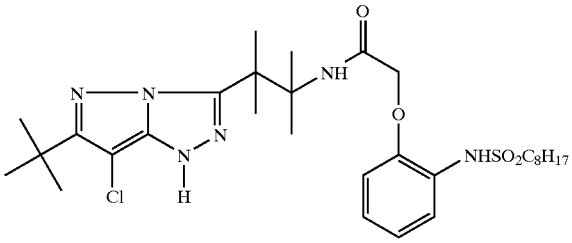

Couplers that form yellow dyes upon reaction with oxidized colour developing agent are described in such representative patents and publications as: U.S. Pat. Nos. 2,298,443,2,407,210, 2,875,057, 3,048,194, 3,265,506, 3,447,928, 3,960,570, 4,022,620, 4,443,536, 4,910,126 and 5,340,703 and "Farbkuppler-eine Literature Übersicht", published in Agfa Mitteilungen, Band III, pp.112–126 (1961). Such couplers are typically open chain ketomethylene compounds.

Also preferred are yellow couplers such as described in, for example, European Patent Application Nos. 482,552, 510,535, 524,540, 543,367 and U.S. Pat. No. 5,238,803. For improved colour reproduction, couplers which give yellow dyes that cut off sharply on the long wavelength side are particularly preferred (for example, see U.S. Pat. No. 5,360,713).

Typical preferred yellow couplers are represented by the following formulae:

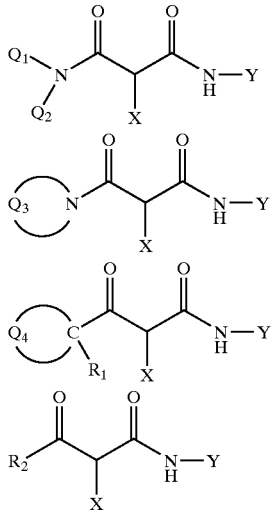

wherein $R_1$, $R_2$, $Q_1$ and $Q_2$ are each a substituent, X is hydrogen or a coupling-off group, Y is an aryl group or a heterocyclic group, $Q_3$ is an organic residue required to form a nitrogen-containing heterocyclic group together with the >N—, and $Q_4$ are nonmetallic atoms necessary to form a 3- to 5-membered hydrocarbon ring or a 3- to 5-membered heterocyclic ring which contains at least one hetero atom selected from nitrogen, oxygen, sulfur and phosphorous in the ring. Particularly preferred is when $Q_1$ and $Q_2$ are each an alkyl group, an aryl group or a heterocyclic group, and $R_2$ is an aryl or tertiary alkyl group.

Preferred yellow couplers have the following structures:

Y-1

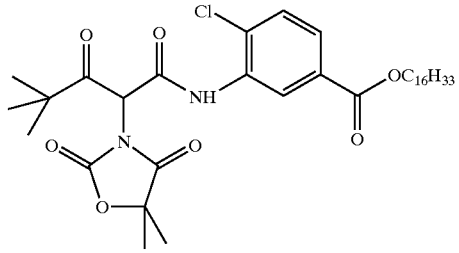

Y-2

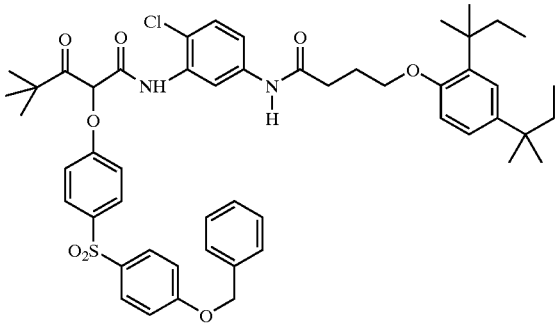

-continued

Y-3

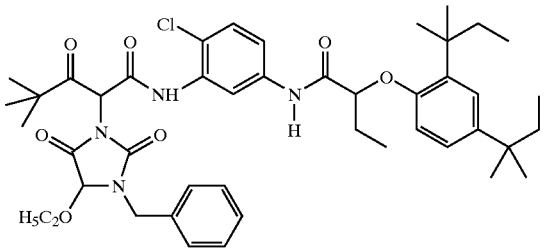

Y-4

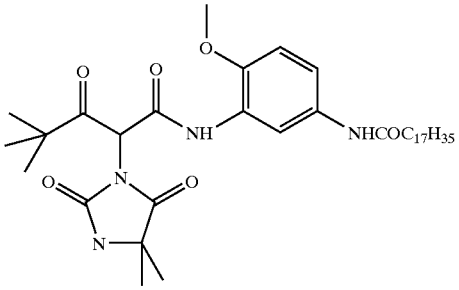

Y-5

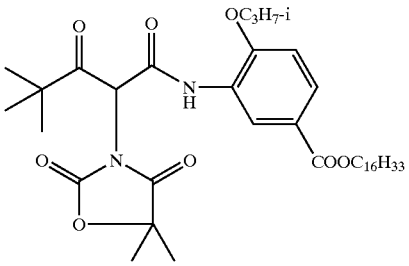

Y-6

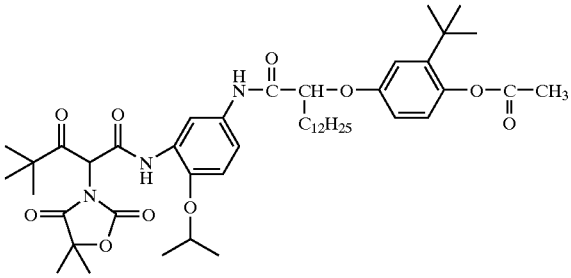

Couplers that form colourless products upon reaction with oxidized colour developing agent are described in such representative patents as: U.K. Patent No. 861,138, U.S. Pat. Nos. 3,632,345, 3,928,041, 3,958,993 and 3,961,959. Typically such couplers are cyclic carbonyl-containing compounds that form colourless products on reaction with an oxidized colour developing agent.

Couplers that form black dyes upon reaction with oxidized colour developing agent are described in such representative patents as U.S. Pat. Nos. 1,939,231, 2,181,944, 2,333,106 and 4,126,461, German OLS No. 2,644,194 and German OLS No. 2,650,764. Typically, such couplers are resorcinols or m-aminophenols that form black or neutral products on reaction with oxidized colour developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343 and 5,234,800.

It may be useful to use additional couplers any of which may contain known ballasts or coupling-off groups such as those described in U.S. Pat. Nos. 4,301,235, 4,853,319 and 4,351,897. The coupler may contain solubilizing groups such as described in U.S. Pat. No. 4,482,629. The coupler may also be used in association with "wrong" coloured couplers (e.g. to adjust levels of interlayer correction) and, in colour negative applications, with masking couplers such as those described in EP 213.490, Japanese Published Application 58-172,647, U.S. Pat. Nos. 2,983,608, 4,070,191 and 4,273,861, German Applications DE 2,706,117 and DE 2,643,965, UK Patent No. 1,530,272 and Japanese Application 58-113935. The masking couplers may be shifted or blocked, if desired.

The materials for use in the invention may be used in association with materials that accelerate or otherwise modify the processing steps e.g. of bleaching or fixing to improve the quality of the image. Bleach accelerator releasing couplers such as those described in EP 193,389; EP 301,477 and in U.S. Pat. Nos. 4,163,669, 4,865,956 and 4,923,784, maybe useful. Also contemplated in use of the compositions in association with nucleating agents, development accelerators or their precursors (UK Patent Nos. 2,097,140 and 2,131,188); electron transfer agents (U.S. Pat. Nos. 4,859,578 and 4,912,025); antifogging and anti colour-mixing agents such as derivatives of hydroquinones, aminophenols, amines, gallic acid; catechol; ascorbic acid; hydrazides; sulfonamidophenols and non colour-forming couplers.

The materials for use in the invention may also be used in combination with filter dye layers comprising colloidal silver sol or yellow, cyan and/or magenta filter dyes, either as oil-in-water dispersions, latex dispersions or as solid particle dispersions. Additionally, they may be used with "smearing" couplers (e.g. as described in U.S. Pat. Nos. 4,366,237, 4,420,556, 4,543,323 and in EP 96,570). Also, the compositions may be blocked or coated in protected form as described, for example, in Japanese Application 61/258,249 or U.S. Pat. No. 5,019,492.

The materials for use in the invention may further be used in combination with image-modifying compounds such as "Developer Inhibitor-Releasing" compounds (DIRs). DIRs useful in conjunction with the compositions of the invention are known in the art and examples are described in U.S. Pat. Nos. 3,137,578, 3,148,022, 3,148,062, 3,227,554, 3,384,657, 3,379,529, 3,615,506, 3,617,291, 3,620,746, 3,701,783, 3,733,201, 4,049,455, 4,095,984, 4,126,459, 4,149,886, 4,150,228, 4,211,562, 4,248,962, 4,259,437, 4,362,878, 4,409,323, 4,477,563, 4,782,012, 4,962,018, 4,500,634, 4,579,816, 4,607,004, 4,618,571, 4,678,739, 4,746,600, 4,746,601, 4,791,049, 4,857,447, 4,865,959, 4,880,342, 4,886,736, 4,937,179, 4,946,767, 4,948,716, 4,952,485, 4,956,269, 4,959,299, 4,966,835, 4,985,336 as well as in patent publications GB 1,560,240, GB 2,007,662, GB 2,032,914, GB 2,099,167, DE 2,842,063, DE 2,937,127, DE 3,636,824, DE 3,644,416 as well as the following European Patent Publications: 272,573, 335,319, 336,411, 346,899, 362,870, 365,252, 365,346, 373,382, 376,212, 377,463, 378,236, 384,670, 396,486, 401,612, 401,613.

Such compounds are also disclosed in "Developer-Inhibitor-Releasing (DIR) Couplers for Color Photography," C. R. Barr, J. R. Thirtle and P. W. Vittum in Photographic Science and Engineering, Vol.13, p.174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercapto-tetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles. In a preferred embodiment, the inhibitor moiety or group is selected from the following formulae:

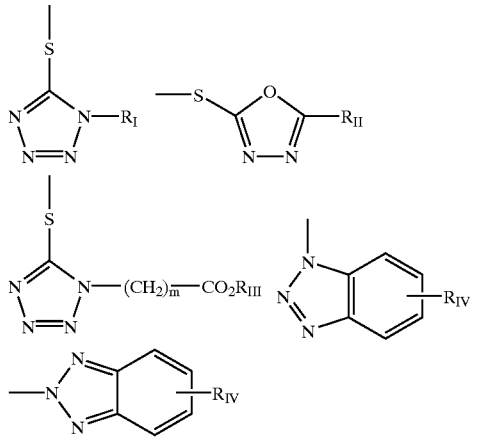

wherein $R_1$ is selected from the group consisting of straight and branched alkyl groups of from 1 to about 8 carbon atoms, benzyl, phenyl and alkoxy groups and such groups containing none, one or more than one such substituent, $R_{II}$ is selected from $R_I$ and —$SR_I$, $R_{III}$, is a straight or branched alkyl group of from 1 to about 5 carbon atoms and m is from 1 to 3, and $R_{IV}$ is selected from the group consisting of hydrogen, halogens and alkoxy, phenyl and carbonamido groups, —$COOR_V$ and —$NHCOOR_V$, wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different colour as one associated with a different film layer. It may also be useful that the coupler moiety included in the developer inhibitor-releasing coupler forms colourless products and/or products that wash out of the photographic material during processing (so-called "universal" couplers).

As mentioned, the developer inhibitor-releasing coupler may include a timing group, which produces the time-delayed release of the inhibitor group, such as groups using an intramolecular nucleophilic substitution reaction (U.S. Pat. No. 4,248,962); groups utilizing an electron transfer reaction along a conjugated system (U.S. Pat. Nos. 4,409,323, 4,421,845 and 4,861,701 and Japanese Applications 57-188035; 58-98728; 58-209736; 58-209738); groups utilizing ester hydrolysis (German Patent Application (OLS) No. 2,626,315); groups that function as a coupler or reducing agent after the coupler reaction (U.S. Pat. Nos. 4,438,193 and 4,618,571) and groups that combine the features described above. It is typical that the timing group is of one of the formulae:

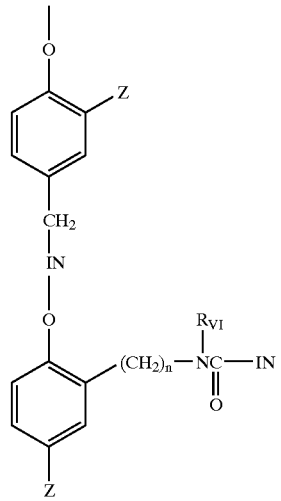

wherein

IN is the inhibitor moiety, Z is selected from the group consisting of nitro, cyano, alkylsulfonyl, sulfamoyl (—$SO_2NR_2$) and sulfonamido (—$NRSO_2R$) groups, n is 0 or 1, and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light sensitive emulsion layer include, but are not limited to, the following:

D1

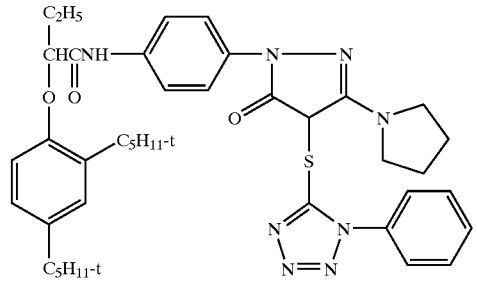

-continued
D2
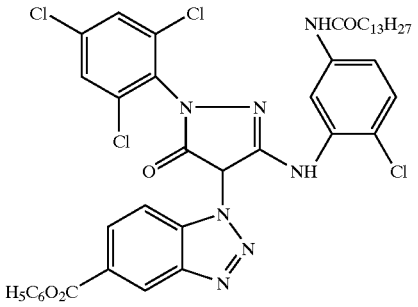
D3
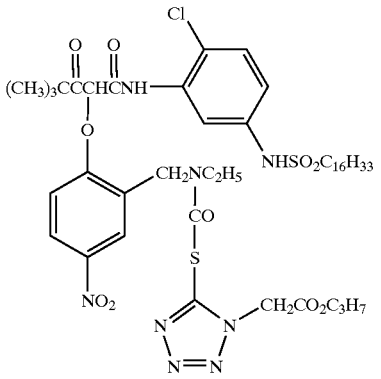
D4
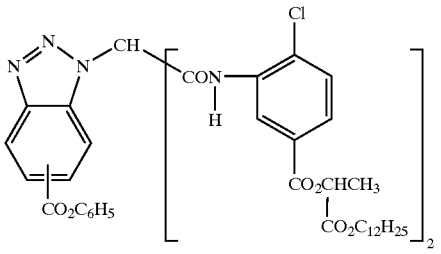
D5
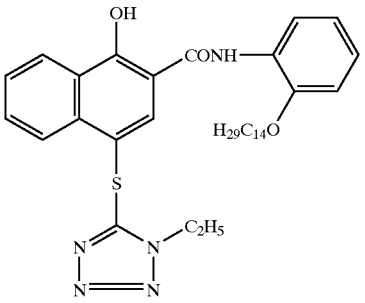
-continued
D6
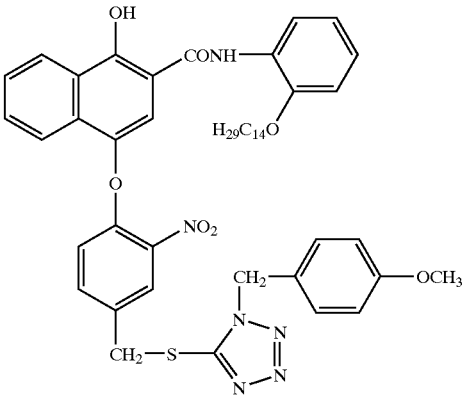
D7
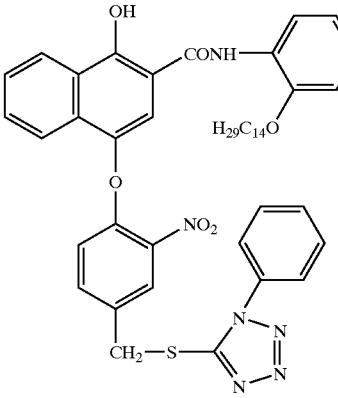
D8
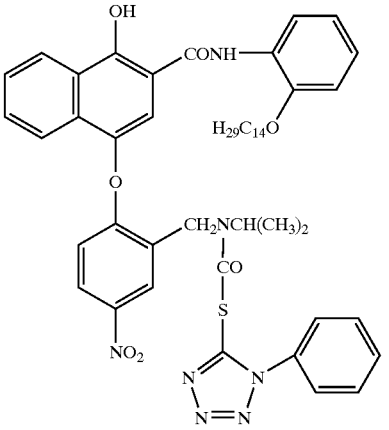
D9
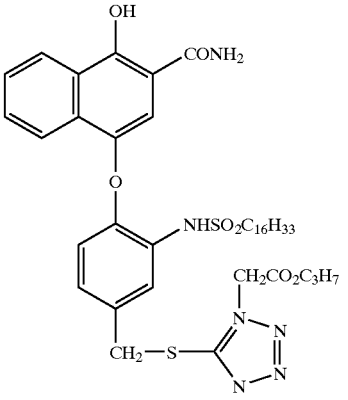

-continued

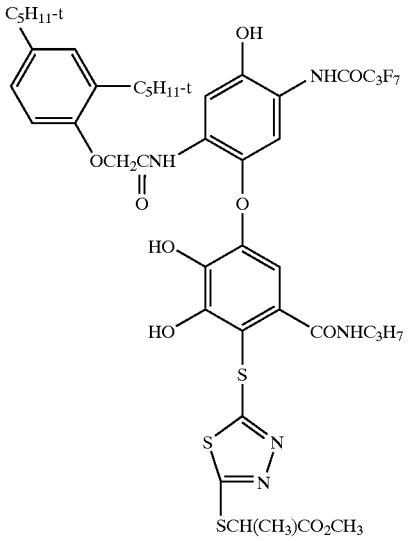

D11

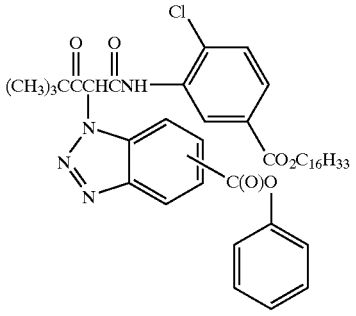

D12

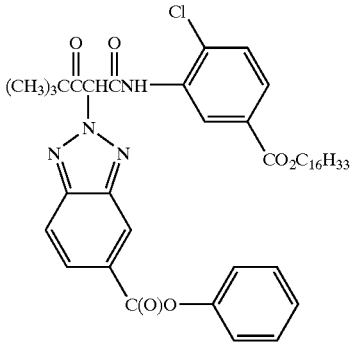

It is also contemplated that the concepts of the present invention may be employed to obtain reflection colour prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994, on a support with reduced oxygen permeability (EP 553,339), with epoxy solvents (EP 164,961), with nickel complex stabilizers (U.S. Pat. Nos. 4,346,165, 4,540,653 and 4,906,559 for example), with ballasted chelating agents such as those in U.S. Pat. No. 4,994,359 to reduce sensitivity to polyvalent cations such as calcium and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630, 90-072,631, 90-072,632, 90-072,633, 90-072,634, 90-077,822, 90-078,229, 90-078,230, 90-079,336, 90-079,337, 90-079,338, 90-079,690, 90-079,691, 90-080,487, 90-080,488, 90-080,489, 90-080,490, 90-080,491, 90-080,492, 90-080,494, 90-085,928, 90-086,669, 90-086,670, 90-087,360, 90-087,361, 90-087,362, 90-087,363, 90-087,364, 90-088,097, 90-093,662, 90-093,663, 90-093,664, 90-093,665, 90-093,666, 90-093,668, 90-094,055, 90-094,056, 90-103,409, 83-62,586 and 83-09,959.

Any silver halide combination can be used for the photographic element, such as silver chloride, silver chlorobromide, silver chlorobromoiodide, silver bromide, silver bromoiodide or silver chloroiodide. In cases where the emulsion composition is a mixed halide, the minor component may be added in the crystal formation or after formation as part of the sensitization or melting. The shape of the silver halide emulsion grain can be cubic, pseudo-cubic, octahedral, tetradecahedral or tabular. The emulsions may be precipitated in any suitable environment such as a ripening environment, a reducing environment or an oxidizing environment.

Specific references relating to the preparation of emulsions of differing halide ratios and morphologies are Evans U.S. Pat. No. 3,618,622, Atwell U.S. Pat. No. 4,269,927, Wey U.S. Pat. No. 4,414,306, Maskasky U.S. Pat. No. 4,400,463, Maskasky U.S. Pat. No. 4,713,323, Tufano et al U.S. Pat. No. 4,804,621, Takada et al U.S. Pat. No. 4,738,398, Nishikawa et al U.S. Pat. No. 4,952,491, Ishiguro et al U.S. Pat. No. 4,493,508, Hasebe et al U.S. Pat. No. 4,820,624, Maskasky U.S. Pat. Nos. 5,264,337 and 5,275,930, House et al U.S. Pat. No. 5,320,938 and Chen et al U.S. Pat. No. 5,550,013, Edwards et al U.S. Ser. No. 08/362,283 filed on Dec. 22, 1994 and U.S. Pat. Nos. 5,726,005 and 5,736,310.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. No. 4,497,895, Yagi et al U.S. Pat. No. 4,728,603, Sugimoto U.S. Pat. No. 4,755,456, Kishita et al U.S. Pat. No. 4,847,190, Joly et al U.S. Pat. No. 5,017,468, Wu U.S. Pat. No. 5,166,045, Shibayama et al EP-A-0 328 042 and Kawai EP-A-0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EP-A-0 434 012, Inoue U.S. Pat. No. 5,185,241, Yamashita et al EP-A-0 369 491, Ohashi et al EP-A-0 371 338, Katsumi EP-A-0 435 270 and EP-A-0 435 355 and Shibayama EP-A-0 438 791. Conversely, oxidizing agents may be present during precipitation, used as a pre-treatment of the dispersing medium (gelatin) or added to the emulsion after grain formation before or during sensitization, in order to improve the sensitivity/fog position of the silver halide emulsion or minimize residual ripening agent, as illustrated by Komatsu et al JP 56-167393 and JP 59-195232, Mifune et al EP-A-0 144 990 and EP-A-0 166 347. Chemically sensitized core grains can serve as hosts for the precipitation of shells, as illustrated by Porter et al U.S. Pat. Nos. 3,206,313 and 3,327,322, Evans U.S. Pat. No. 3,761,276, Atwell et al U.S. Pat. No. 4,035,185 and Evans et al U.S. Pat. No. 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive- or (a2) negative-working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", *Photographic Science and Engineering*, Vol. 24, No. 6 November/December 1980, (265–267).

Dopants can be added in conjunction with addenda, antifoggants, dye and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965, Shiba et al U.S. Pat. No. 3,790,390, Habu et al U.S. Pat. No. 4,147,542 Hasebe et al EP-A-0 273 430 Ohshima et al EPO 0 312 999 and Ogawa U.S. Statutory Invention Registration H760.

Desensitizing, contrast increasing or reciprocity failure reducing ions or complexes are typically dopants which function to trap photogenerated holes or electrons by introducing additional energy levels deep within the bandgap of the host material. Examples include, but are not limited to, simple salts and complexes of Groups 8–10 transition metals (e.g. rhodium, iridium, cobalt, ruthenium, and osmium) and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$ and $K_2Os(NS)Cl_5$. Amine, oxalate, and organic ligand complexes or ions of these or other metals as disclosed in Olm et al U.S. Pat. Nos. 5,360,712 and 5,457,021 and in Kuromoto et al U.S. Pat. No. 5,462,849 are also contemplated. Specific examples include $[IrCl_4(ethylenediamine)_2]^{31\ 1}$, $IrCl_4(CH_3SCH_2CH_2SCH_3)]^{-1}$, $[IrCl_5(pyrazine)]^{-2}$, $[IrCl_5(chloropyrazine)]^{-2}$, $[IrCl_5(N\text{-methylpyrazinium})]^{-1}$, $[IrCl_5(pyrimidine)]^{-2}$, $[IrCl_5(pyridine)]^{-2}$, $[IrCl_4(pyridine)_2]^{-1}$, $[IrCl_4(oxalate)_2]^{-3}$, $[IrCl_5(thiazole)]^{-2}$, $[IrCl_4(thiazole)_2]^{-1}$, $[IrCl_4(2\text{-bromothiazole})_2]^{-1}$, $[IrCl_5(5\text{-methylthiazole})]^{-2}$, $[IrBr_5(thiazole)]^{-2}$ and $[IrBr_4(thiazole)_2]^{-1}$.

In a specific, preferred form it is contemplated to employ as a dopant a hexacoordination complex satisfying the formula: $[ML_6]^n$ where M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$, $Pt^{+4}$; $L_6$ represents six coordination complex ligands which can be independently selected, provided that least four of the ligands are anionic ligands and at least one (preferably at least 3 and optimally at least 4) of the ligands is more electro-negative than any halide ligand and n is -2, -3 or -4.

The following are specific illustrations of dopants capable of providing shallow electron traps:

| | | | |
|---|---|---|---|
| $[Fe(CN)_6]^{-4}$ | SET-1 | $[Ru(CN)_6]^{-4}$ | SET-2 |
| $[Os(CN)_6]^{-4}$ | SET-3 | $[Rh(CN)_6]^{-3}$ | SET-4 |
| $[Ir(CN)_6]^{-3}$ | SET-5 | $[Fe(pyrazine)(CN)_5]^{-4}$ | SET-6 |
| $[RuCl(CN)_5]^{-4}$ | SET-7 | $[OsBr(CN)_5]^{-4}$ | SET-8 |
| $[RhF(CN)_5]^{-3}$ | SET-9 | $[IrBr(CN)_5]^{-3}$ | SET-10 |
| $[FeCO(CN)_5]^{-3}$ | SET-11 | $[RuF_2(CN)_4]^{-4}$ | SET-12 |
| $[OsCl_2(CN)_4]^{-4}$ | SET-13 | $[RhI_2(CN)_4]^{-3}$ | SET-14 |
| $[IrBr_2(CN)_4]^{-3}$ | SET-15 | $[Ru(CN)_5(OCN)]^{-4}$ | SET-16 |
| $[Ru(CN)_5(N_3)]^{-4}$ | SET-17 | $[Os(CN)_5(SCN)]^{-4}$ | SET-18 |
| $[Rh(CN)_5(SeCN)]^{-3}$ | SET-19 | $[Ir(CN)_5(HOH)]^{-2}$ | SET-20 |
| $[Fe(CN)_3Cl_3]^{-3}$ | SET-21 | $[Ru(CO)_2(CN)_4]^{-1}$ | SET-22 |
| $[Os(CN)Cl_5]^{-4}$ | SET-23 | $[Co(CN)_6]^{-3}$ | SET-24 |
| $[Ir(NCS)_6]^{-3}$ | SET-25 | $[In(NCS)_6]^{-3}$ | SET-26 |
| $[Ga(NCS)_6]^{-3}$ | SET-27 | | |

It is additionally contemplated to employ oligomeric coordination complexes to increase speed, as taught by Evans et al U.S. Pat. No. 5,024,931, the disclosure of which is here incorporated by reference.

The dopants are effective in conventional concentrations, where concentrations are based on the total silver, including both the silver in the grains and the silver in epitaxial protrusions. Generally shallow electron trap forming dopants are contemplated to be incorporated in concentrations of at least $1\times10^{-8}$ mol per silver mol up to their solubility limit, typically up to about $10^{-3}$ mol per silver mol. Preferred concentrations are in the range of from about $10^{-6}$ to $10^{-4}$ mol per silver mol. When used in the presence of other deep electron trapping dopants, such as $Cs_2Os(NO)Cl_5$, preferred concentrations of shallow electron traps may approach $10^{-8}$ to $10^{-7}$ mol per silver mol. Combinations of deep and shallow electron trapping dopants may be used to increase contrast as taught by MacIntyre and Bell in U.S. Pat. No. 5,597,686 and by Bell in U.S. Pat. Nos. 5,252,451, 5,256,530, 5,385,817, 5,474,888, 5,480,771 and 5,500,335. It is, of course, possible to distribute the dopant so that a portion of it is incorporated in grains and the remainder is incorporated in the silver halide epitaxial protrusions.

Emulsion addenda that adsorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EP-A-0 287,100 and Tadaaki et al EP-A-0 301,508. Non-dye addenda are illustrated by Klotzer et al U.S. Pat. No. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008 and Vandenabeele et al EP-A-0 392,092. Water soluble disulfides are illustrated by Budz et al U.S. Pat. No. 5,418,127.

Chemical sensitization of the materials in this photographic element is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold or gold only sensitizations are very effective sensitizers. Typical gold sensitizers are chloroaurates, aurous dithiosulfate, aqueous colloidal gold sulfide or aurous bis(1,4,5-trimethyl-1,2,4-triazolium-3-thiolate) tetrafluoroborate (e.g. U.S. Pat. No. 5,049,485). Sulfur sensitizers may include thiosulfate, thiocyanate, N,N'-carbothioyl-bis (N-methylglycine) or 1,3-dicarboxymethyl-1,3-dimethyl-2-thiourea sodium salt.

The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfonates, such as tolylthiosulfonate (optionally used with arylsulfinates such as tolylsulfinate) or esters thereof are especially useful (e.g. U.S. Pat. No. 4,960,689). The use of water-soluble disulfides is illustrated in U.S. Pat. No. 5,830,631.

Tabular grain silver halide emulsions may be used in the present invention. Specifically contemplated tabular grain emulsions are those in which greater than 50 percent of the total projected area of the emulsion grains are accounted for by tabular grains having a thickness of less than 0.3 micrometers (0.5 micrometers for blue sensitive emulsion) and an average tabularity (T) of greater than 25 (preferably greater than 100), where the term "tabularity" is employed in its art recognized usage as $$T=ECD/t^2$$

wherein

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky in U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520, 4,414,310, 4,433,048, 4,643,966, 4,647,528, 4,665,012, 4,672,027, 4,678,745, 4,693,964, 4,713,320, 4,722,886, 4,755,456, 4,775,617, 4,797,354, 4,801,522, 4,806,461, 4,835,095, 4,853,322, 4,914,014, 4,962,015, 4,985,350, 5,061,069 and 5,061,616.

The emulsions can be surface-sensitive emulsions, i.e. emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a colour developing agent to reduce developable silver halide and oxidize the colour developing agent. Oxidized colour developing agent in turn reacts with the coupler to yield a dye.

With negative-working silver halide, the processing step described above provides a negative image. The described elements can be processed in the known Kodak C-41™ colour process as described in The British Journal of Photography Annual of 1988, pp 191–198. Where applicable, the element may be processed in accordance with colour print processes such as the RA-4™ process of Eastman Kodak Company as described in the British Journal of Photography Annual of 1988, pp 198–199. Such negative working emulsions are typically sold with instructions to process using a colour negative method such as the C-41™ or RA-4™ process. To provide a positive (or reversal) image, the colour development step can be preceded by development with a non-chromogenic developing agent to develop exposed silver halide, but not form dye, and followed by uniformly fogging the element to render unexposed silver halide developable. Such reversal emulsions are typically sold with instructions to process using a colour reversal process such as E-6™. Alternatively, a direct positive emulsion can be employed to obtain a positive image.

The multicolour photographic elements of the invention may be processed alternatively in a developer solution that will provide reduced processing times of one minute or less (dry to dry), and particularly reduced colour development times of less than about 25 seconds, such that all colour records are fully developed with aim sensitometry.

Preferred colour developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing or bleach-fixing, to remove silver or silver halide, washing and drying.

The coupler dispersions may be coated with emulsions to form photographic elements at very low levels of silver (less than 100 mg/m$^2$). Reasons for doing this include reducing cost, reducing the thickness of silver halide emulsion layers to gain sharpness advantages and reducing the environmental impact during and after processing.

One class of low silver photographic material is colour material intended for redox amplification processes wherein the developed silver acts as a catalyst to the formation of the dye image. This process can take place in a low volume thin processor, such as a low volume thin tank (LVTT), for example, as disclosed in U.S. Pat. No. 5,436,118. Redox amplification processes have been described for example in GB Patent Nos. 1,268,126, 1,399,481, 1,403,418, 1,560,572 and U.S. Pat. Nos. 3,748,138, 3,822,129 and 4,097,278. In such processes, colour materials are developed to produce a silver image (which may contain only small amounts of silver) and are then treated with a redox amplifying solution (or a combined developer-amplifier) to form a dye image.

The following examples illustrate the invention but are in no way to be construed as being limiting thereof.

EXAMPLES

Preparative Examples

The cyclic bisphenol phosphonate compound ST1 can be prepared from the corresponding commercially available bisphenol as described in EP-A-0 913 729 and as exemplified in Example 1 below. The silicon-blocked bisphenol can be prepared from the corresponding commercially available bisphenol as described in EP-A-1 191 398 and as exemplified for ST25 in Example 2 below. Other stabilizers can be prepared accordingly by appropriate choice of bisphenol starting material. For example the boron-blocked stabiliser ST53 can be prepared according to the method described in S. D. Pastor and J. D. Spivack, Journal of Heterocyclic Chemistry, 1983, 20, 1311.

The synthesis of the cyan dye-forming couplers is well described in the literature, for example as described in U.S. Pat. No. 6,004,738, EP-A-1 037 103 and DE 197 01 869. The UV absorbers used in this invention are all available either commercially or prepared using standard methods.

Example 1

Synthesis of ST1

2,2'-Methylenebis(6-t-butyl-4-ethylphenol), which is commercially available and has CAS Reg. No. [88-24-4], (74.0 g, 0.2 mol) was dissolved in toluene (300 ml) and stirred in an acetone-ice bath. Triethylamine (46.0 g, 0.45 mol) and 4-dimethylaminopyridine (DMAP) (6.0 g, 0.05 mol) were added followed by the controlled addition of phenyl phosphonic dichloride (0.22 mol) over 0.5 h. Stirring was allowed to continue at room temperature for a further 16 h, then the heavy precipitate of triethylamine hydrochloride was filtered off and discarded. The filtrate was evaporated to dryness then partitioned between ethyl acetate and dilute hydrochloric acid (300 ml each). The organic layer was separated and dried ($MgSO_4$) and the solvent removed in vacuo to give the crude product as a viscous oil which gradually solidified. The material was purified by column chromatography in silica, eluting with a 10:1 mixture of 60/80 petrol-ethyl acetate. The product was obtained as a pale yellow solid which was triturated with 60/80 petrol to give colourless crystals, 51.2 g, (52%).

Calcd. for $C_{31}H_{39}O_3P$:
C, 75.9; H, 8.0%

Found: C, 75.7; H, 7.8%

HPLC gave a purity of 99% and the correct structure was further confirmed by nmr/mass spectra.

Example 2

Synthesis of ST25

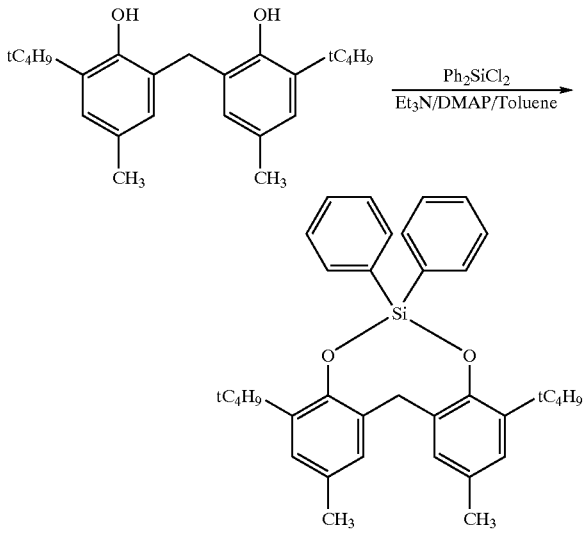

A solution of commercially available 2,2'-methylenebis (6-t-butyl-4-methylphenol)] CAS Reg. No [119-47-1] (34.0 g, 0.1 mol) in toluene (250 ml) was stirred in an acetone-ice bath with triethylamine (21 g, 0.2 mol) and a catalytic quantity of DMAP (1 g). The dichlorosilane (30.4 g, 0.12 mol) in toluene (60 ml) was dripped in over 30 min, the ice bath removed and the solution stirred at room temp for 1 h. During this time much triethylamine HCl salt precipitated out and this was removed by filtration. The filtrate was evaporated to dryness in vacuo, then the orange viscous oily residue was taken up in ethyl acetate (300 ml) and washed with water. After drying over $MgSO_4$, the organic layer was evaporated to give the crude product as an orange coloured oil which gave a cream solid on trituration with acetonitrile. The solid was collected by filtration and crystallised further from methanol to give the final product as a white crystalline solid, 36.5 g (70%), m.p.=139–140C.

GC/MS—shows one component only consistent with product (molecular ion m/z 520).

Calcd. For $C_{35}H_{40}O_2Si$;
C, 80.7; H, 7.7%.

Found: C, 80.7; H, 7.8%.

Example 3

Synthesis of ST53

2,2'-Methylenebis(6-t-butyl-4-ethylphenol) CAS Reg. No. [88-24-4] (31.8 g, 0.08 mol) and phenylboronic acid CAS Reg. No. [98-80-6] (10.0 g, 0.08 mole) were refluxed in toluene (250 ml) in the presence of a catalytic quantity of 4-toluenesulfonic acid (1 g) under Dean-Stark conditions. After 7 h reflux, solvent was removed under reduced pressure and the dark solid residue crystallised (×3) from acetonitrile to give product as off-white needles, 10.2 g (28%), mp 167–169C.

Calcd. For $C_{31}H_{39}O_2BO_2$;
C, 81.9; H, 8.6%.

Found: C, 81.8; H, 8.7%.

The correct structure was further confirmed by nmr/mass spectra.

PHOTOGRAPHIC EXAMPLES

Dispersion Examples

Example 4

In this example a comparative dispersion formulation containing a cyclic phosphonate stabilizer (utilizing oil phase components derived from U.S. Pat. No. 6,004,738) was made and its droplet size and activity compared with formulations used or useful in the invention.

A comparative coupler dispersion was prepared by heating to 145C. a combination of coupler AC41 (28 g) with phenolic solvent G (28 g) and Stabilizer ST1 (28 g) plus triethyl citrate (7 g) until a solution was formed.

A gelatin solution made from decalcified gelatin (28 g) in demineralised water (275 g) and a 10% solution of surfactant Alkanol XC™ (33 g) were heated at 80C.

The coupler and gelatin solutions were combined and mixed for 4 min. at 10000 rpm using a Polytron (a rotor stator device manufactured by Kinematica instruments, Switzerland). The mixture was then homogenised by passing it through an M-110F. Microfluidizer (manufactured by Microfluidics Corp.) at 75C. and 86,188 kPa (12,5000 psi) pressure. This was done three times in order to obtain a reasonable droplet size.

A dispersion used or useful in the invention was made as before, but using a combination of couplers: AC41 (14 g) and BC3 (9.3 g) in solvent A (28 g) plus triethyl citrate (7 g), with stabilizer ST1 (28 g) and also UV1 (18 g). The gelatin solution was identical except for less water (233 g). This dispersion was homogenised utilising the same conditions as before, except that only one pass through the Microfluidizer was needed. A similar dispersion used or useful in the invention was also made in the same way but using solvent G instead of solvent A; this was also passed once through the Microfluidizer.

The average droplet diameter of the three dispersions was measured using a turbidimetric technique and the dispersions were coated in the format below and exposed and processed as described. The cyan dye-forming dispersions were incorporated in layer 5 at the laydowns shown in TABLE 2.

Other materials which were used in the comparative dispersions or in the preparation of the photographic elements are shown below.

Coupler MC1

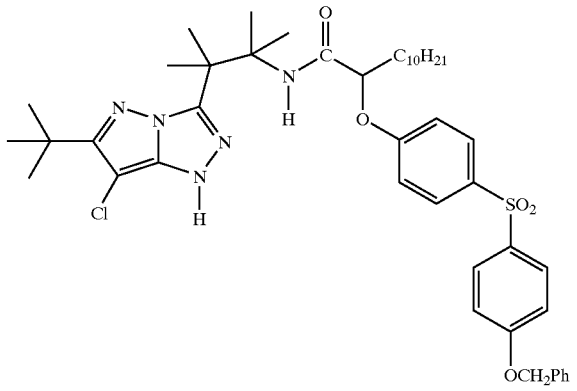

-continued

Coupler YC1

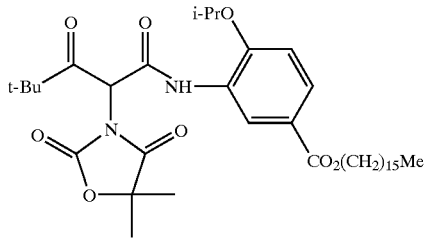

Solvent A $CH_3(CH_2)_7CH{=}CH(CH_2)_8OH$

Solvent B

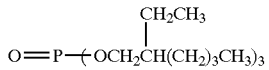

Solvent C

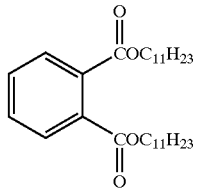

Solvent D

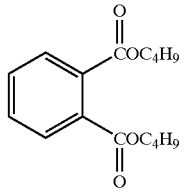

Solvent E

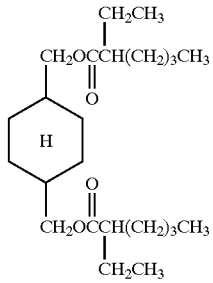

Solvent F

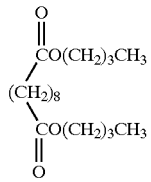

Solvent G

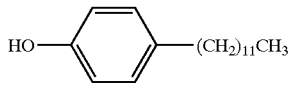

Stain prevention agent H

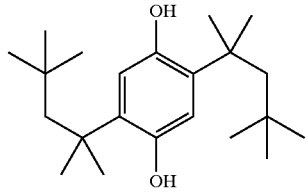

-continued

Fade prevention agent I

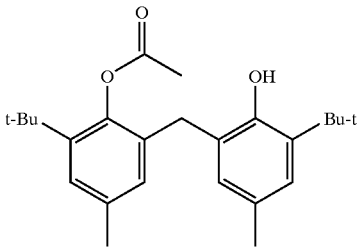

Fade prevention agent J

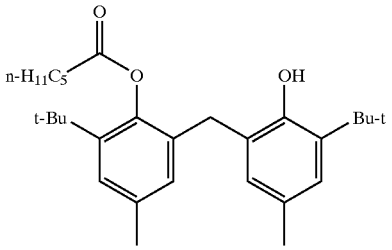

Fade Prevention agent, K

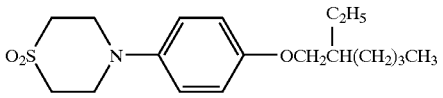

Fade prevention agent, L

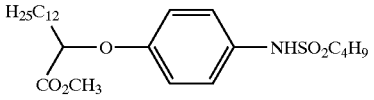

Hardener M

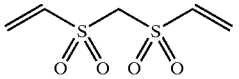

TABLE 1

Structure Of Photographic Element

| Layer | Component | Coverage |
|---|---|---|
| Layer 7 | Gelatin | 0.57 g/m$^2$ |
| Layer 6 | Gelatin | 0.62 g/m$^2$ |
| (UV light | UV light absorbing agents: | 0.186 g/m$^2$ |
| absorbing | (UV1:UV3, 1:0.18) | 46.67 mg/m$^2$ |
| layer) | Stain prevention agent, H | 61.97 mg/m$^2$ |
| | Solvents for UV absorbing agents: | |
| | (D:E, 1:1) | |
| Layer 5 | Gelatin | 1.36 g/m$^2$ |
| (Red-sensitive | Silver chloride emulsion | 0.19 g Ag/m$^2$ |
| layer) | Coupler(s) | See Tables below |
| | Stabilizer(s) for cyan coupler(s) | See Tables below |
| | Solvent for cyan coupler(s) | See Tables below |
| | Hardener, M | 0.18 g/m$^2$ |
| Layer 4 | Gelatin | 0.62 g/m$^2$ |
| (UV light | UV light absorbing agents: | 0.187 g/m$^2$ |
| absorbing | (UV1:UV3, 1:0.18) | 46.67 /m$^2$ |
| layer) | Stain prevention agent, H | 61.97 mg/m$^2$ |
| | Solvent for UV absorbing agents: | |
| | (D:E, 1:1) | |
| Layer 3 | Gelatin | 1.49 g/m$^2$ |
| (green-sensitive | Silver chloride emulsion | 0.13 g/m$^2$ |
| layer) | Magenta coupler, MC1 | 0.30 g/m$^2$ |
| | Fade prevention agents: | 0.64 g/m$^2$ |
| | (L:K, 1.9:0.3) | 0.31 g/m$^2$ |
| | Solvents for magenta coupler: | |
| | (A:C, 0.35:0.67) | |

TABLE 1-continued

Structure Of Photographic Element

| Layer | Component | Coverage |
|---|---|---|
| Layer 2 | Gelatin | 0.75 g/m$^2$ |
| (colour stain | Stain prevention agent, H | 65.91 mg/m$^2$ |
| prevent. layer) | Solvent for stain prevention agent, D | 0.19 g/m$^2$ |
| Layer 1 | Gelatin | 1.19 g/m$^2$ |
| (blue-sensitive | Silver chloride emulsion | 0.28 g/m$^2$ |
| layer) | Yellow coupler, YC1 | 0.65 g/m$^2$ |
| | Fade prevention agents: | 0.15 g/m$^2$ |
| | (I:J, 0.17:0.06) | 0.28 g/m$^2$ |
| | Solvent for yellow coupler, C | |
| Support | Gelatin over polyethylene laminated paper base | 0.30 g/m$^2$ |

Processed samples were prepared by exposing the coatings through a step tablet (density range 0–3, 0.15 inc.) and developed for 0.1 s and processed through a Kodak Process RA-4™ as follows.

| Process Step | Time (min.) | Temp. (C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts/litre solution):

| Developer | |
|---|---|
| Triethanolamine | 12.41 g |
| Blankophor REU ™ | 2.30 g |
| Lithium polystyrene sulfonate | 0.09 g |
| N,N-Diethylhydroxylamine | 4.59 g |
| Lithium sulfate | 2.70 g |
| Developing agent, Dev1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7 C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7 C. | |

Dev 1

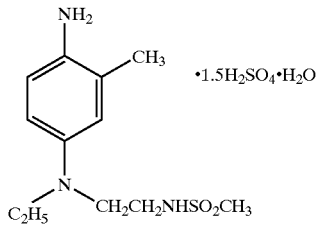

The values for Status A red contrast were recorded and the contrast (γ) was measured by calculating the slope of the D logE plot over the range of 0.6 logE centred on the exposure yielding 1.0 density. The results are shown below in TABLE 2.

TABLE 2

| Element | IIA & laydown (g/m²) | IIB & laydown (g/m²) | Solvent & laydown (g/m²) | III & laydown (g/m²) | I & laydown (g/m²) | No. of passes through homogeniser | Mean Droplet dia. (μm) | γ | |
|---|---|---|---|---|---|---|---|---|---|
| 101 | AC41 0.640 | — | G 0.640 | — | ST1 0.640 | 1 | 0.30 | — | Comp. |
| 102 | AC41 0.640 | — | G 0.640 | — | ST1 0.640 | 3 | 0.23 | 2.80 | Comp. |
| 103 | AC41 0.320 | BC3 0.210 | A 0.640 | UV1 0.410 | ST1 0.640 | 1 | 0.18 | 3.05 | Inv. |
| 104 | AC41 0.302 | BC3 0.199 | G 0.604 | UV1 0.389 | ST1 0.604 | 1 | 0.22 | 2.84 | Inv. |

The data show that even though the comparative dispersion was passed through the homogeniser three times (bringing the dispersion droplet size down from 0.3 μm after 1 pass to 0.23 μm after three passes) at fairly extreme conditions of temperature and pressure, the droplets were still larger than those of the dispersions used or useful in the invention and consequently the comparative dispersion formulation was not as active as those dispersions.

The data also show that the formulation Element 104, used or useful in the invention, with its lower coupler laydown and using the same solvent as the comparative formulation also shows higher contrast than the comparative formulation. This dispersion formulation had a droplet size of 0.22 μm after only one pass through the homogeniser.

These data indicate that it is difficult to attain small droplet sizes (and hence higher dispersion reactivity) for the comparative dispersion without using relatively high levels of a volatile organic solvent (such as ethyl acetate) in the oil phase (as described in U.S. Pat. No. 6,004,738) and the inevitable evaporation, even if not deliberately applied, which occurs as a consequence of the melting and coating procedure. The data also show that although the dispersion formulations used or useful in the invention had higher %-solids loading than the comparative formulation, smaller droplet sizes were achievable. This does not preclude the use of evaporation as a step towards smaller droplets for the dispersions used or useful in the invention, but it does show that smaller droplets are easier to obtain than for the comparative dispersion formulation.

Example 5

The coupler solutions for the dispersions were prepared by heating to 145C. mixtures of a stabilizer of formula (I), a coupler of formula (IIA), a coupler of formula (IIB), a UV absorber of formula (III) and a solvent in the combinations which, when coated, would give the laydowns shown in the tables below. Gelatin solutions made from decalcified gelatin in demineralised water and a 10% solution of surfactant Alkanol XC™ were heated at 80C.

In each case the coupler and gelatin solutions were combined and mixed for 4 min at 10000 rpm using a Polytron (a rotor stator device manufactured by Kinematica instruments, Switzerland). The mixture was then homogenised by passing it once through an M-110F. Microfluidizer (manufactured by Microfluidics Corp.) at 75C. and 86,188 kPa (12,5000 psi) pressure. The final dispersion consisted of 7% gelatin and 0.83% Alkanol XC™. Each dispersion was placed in cold storage until ready for coating.

A light sensitive photographic multilayer coating was made to the format shown in TABLE 1. The cyan dye-forming dispersions were incorporated in layer 5 at the laydowns shown in TABLE 3.

The Status A red densities of the processed strips were read and sensitometric curves (density vs. log exposure (D logE)) were generated and the maximum red density ($D_{max}$) recorded in TABLE 3.

The reflectance spectra of the image dyes were also measured and normalised to a maximum absorption of 1.00. From these spectra the wavelength at maximum absorption $\lambda_{max}$ was measured and reported in TABLE 3.

The light stability of the image dyes was tested by exposing the processed strips to the light from a Xenon arc lamp at an intensity of 50 klux for four weeks. The fade from the initial density of 1.00 is reported as a percentage under the column heading "Light fade" in TABLE 3

The dark stability of the image dyes was tested by maintaining the processed strips for 12 weeks at a temperature of 75C. and 50% relative humidity. The fade from the initial density of 1.00 is reported as a percentage in TABLE 3.

TABLE 3

| Element | IIA & laydown (g/m²) | IIB & laydown (g/m²) | Solvent & laydown (g/m²) | III & laydown (g/m²) | I & laydown (g/m²) | $\lambda_{max}$ (nm) | $D_{max}$ | % Light Fade | % Dark Fade | |
|---|---|---|---|---|---|---|---|---|---|---|
| 105 | — | BC3 0.423 | D 0.415 | UV1 0.272 | — | 659.1 | 2.45 | −24 | −25 | Comp. |
| 106 | AC41 0.640 | — | A 0.640 | — | ST1 0.640 | 647.4 | 2.70 | −31 | +10 | Comp. |
| 107 | AC41 0.320 | BC3 0.210 | A 0.640 | — | ST1 0.640 | 656.3 | 2.81 | −30 | −12 | Comp. |
| 108 | AC41 0.320 | BC3 0.210 | A 0.640 | UV1 0.410 | ST1 0.640 | 655.3 | 2.70 | −22 | −6 | Inv. |

The data in TABLE 3 show that although it is possible to gain good density by combining two types of coupler with one of the stabilizers, light stability is poor when compared with element 105, which was the formulation used in commercial material. Light and dark stability are best where the combination of stabilizer, UV absorber and coupler are used together as in

Example 6

The dispersions in this example were made in the same way as described in Example 5 except that a homogenisation temperature of 55C. and pressure of 62,046 kPa (9000 psi) were used instead. The dispersions were coated in layer 5 of the format shown below in TABLE 4 at the laydowns shown in TABLE 5.

TABLE 4

Structure of Photographic Element.

| Layer | Component | Coverage |
|---|---|---|
| Layer 7 | Gelatin | 0.65 g/m$^2$ |
| Layer 6 | Gelatin | 0.51 g/m$^2$ |
| (UV light | UV light absorbing agents: | 0.15 g/m$^2$ |
| absorbing | (UV1:UV3, 1:0.18) | 66.7 mg/m$^2$ |
| layer) | Stain prevention agent, H | 73.8 mg/m$^2$ |
| | Solvents for UV absorbing agents: (D:E, 1:1) | |
| Layer 5 | Gelatin | 1.36 g/m$^2$ |
| (Red- | Silver chloride emulsion | 0.17 g Ag/m$^2$ |
| sensitive | Coupler(s) | See Tables below |
| layer) | Stabilizer(s) for cyan coupler(s) | See Tables below |
| | Solvent for cyan coupler(s) | See Tables below |
| | Hardener, M | 0.18 g/m$^2$ |

TABLE 4-continued

Structure of Photographic Element.

| Layer | Component | Coverage |
|---|---|---|
| Layer 4 | Gelatin | 0.74 g/m$^2$ |
| (UV light | UV light absorbing agents: | 0.22 g/m$^2$ |
| absorbing | (UV1:UV3, 1:0.18) | 97.3 mg/m$^2$ |
| layer) | Stain prevention agent, H | 73.8 mg/m$^2$ |
| | Solvent for UV absorbing agents: (D:E, 1:1) | |
| Layer 3 | Gelatin | 1.42 g/m$^2$ |
| (green- | Silver chloride emulsion | 0.12 g/m$^2$ |
| sensitive | Magenta coupler, MC1 | 0.31 g/m$^2$ |
| layer) | Fade prevention agents: (L:K, 1.9:0.3) | 0.68 g/m$^2$ |
| | Solvents for magenta coupler: (A:C, 0.35:0.67) | 0.32 g/m$^2$ |
| Layer 2 | Gelatin | 0.75 g/m$^2$ |
| (colour stain | Stain prevention agent, H | 107.6 mg/m$^2$ |
| preventing | Solvent for stain prevention agent, D | 0.19 g/m$^2$ |
| layer) | | |
| Layer 1 | Gelatin | 1.31 g/m$^2$ |
| (blue- | Silver chloride emulsion | 0.27 g/m$^2$ |
| sensitive | Yellow coupler, YC1 | 0.65 g/m$^2$ |
| layer) | Fade prevention agents: (I:J, 0.17:0.06) | 0.15 g/m$^2$ |
| | Solvent for yellow coupler, C | 0.28 g/m$^2$ |
| Support | Gelatin | 0.30 g/m$^2$ |
| | over polyethylene laminated paper base | |

The coatings were exposed, and processed in the same way as in Example 5 and the results are shown in TABLE 5 below. In this example, improvements in light and dark stability were looked for relative to coatings which contained the couplers, UV absorber used or useful in the invention, but did not have a stabilizer of formula (I). More couplers of formula (II) were tested and coated laydowns were reduced relative to those in Examples 4 and 5.

TABLE 5

| Element | IIA & laydown (g/m$^2$) | IIB & laydown (g/m$^2$) | Solvent & laydown (g/m$^2$) | III & laydown (g/m$^2$) | I & laydown (g/m$^2$) | % Light Fade | % Dark Fade | |
|---|---|---|---|---|---|---|---|---|
| 109 | AC41 | BC3 | A | UV1 | — | −30 | −22 | Comp. |
| | 0.302 | 0.199 | 0.603 | 0.389 | | | | |
| 110 | AC41 | BC3 | A | UV1 | ST1 | −24 | −11 | Inv. |
| | 0.302 | 0.199 | 0.603 | 0.389 | 0.604 | | | |
| 111 | AC41 | BC3 | A | UV1 | ST1 | −24 | −9 | Inv. |
| | 0.25 | 0.25 | 0.603 | 0.389 | 0.604 | | | |
| 112 | AC41 | BC3 | G | UV1 | ST1 | −19 | −6 | Inv. |
| | 0.25 | 0.25 | 0.603 | 0.389 | 0.604 | | | |
| 113 | AC41 | BC3 | F | UV1 | ST1 | −22 | −3 | Inv. |
| | 0.25 | 0.25 | 0.603 | 0.389 | 0.604 | | | |
| 114 | AC41 | BC3 | A | UV1 | ST1 | −23 | −7 | Inv. |
| | 0.25 | 0.25 | 0.300 | 0.500 | 0.200 | | | |
| 115 | AC70 | BC3 | A | UV1 | ST1 | −25 | −11 | Inv. |
| | 0.250 | 0.250 | 0.300 | 0.500 | 0.200 | | | |
| 116 | AC41 | BC3 | A | UV1 | ST1 | −26 | −9 | Inv. |
| | 0.211 | 0.139 | 0.422 | 0.272 | 0.422 | | | |
| 117 | AC41 | BC3 | A | UV1 | ST1 | −25 | −8 | Inv. |
| | 0.100 | 0.25 | 0.450 | 0.272 | 0.422 | | | |
| 118 | AC7 | BC3 | A | UV1 | ST1 | −21 | −15 | Inv. |
| | 0.175 | 0.175 | 0.337 | 0.242 | 0.337 | | | |

The data in TABLE 5 show that for each combination of couplers there is an improvement in light and dark stability of the coatings when the UV absorber is combined with the cyclic phosphonate stabilizer. Elements 116, 117 and 118 show that coupler laydown can be reduced significantly compared with the comparative example without the cyclic phosphonate stabilizer, but light and dark stability are still improved.

Example 7

In this example, similar formulations with and without the stabilizer of formula (I) are used with a coupler of formula (IIB).

The dispersions in this example were made in the same way as described in Example 6. They were coated in the format shown above in TABLE 4 at the layer 5 laydowns shown in TABLE 6 below. The coatings were exposed and processed in the same way as in Example 5 and the results are shown in TABLE 6 below. In this example improvements in dark stability were looked for relative to a coating of the comparative example 119, because this class of coupler generally suffers from poor dark stability.

TABLE 6

| Element | Coupler IIB & laydown ($g/m^2$) | Solvent & laydown ($g/m^2$) | III & laydown ($g/m^2$) | I & laydown ($g/m^2$) | % Dark Fade | |
|---|---|---|---|---|---|---|
| 119 | BC3 0.423 | D 0.414 | UV1 0.272 | — | 28 | Comp. |
| 120 | BC3 0.350 | A 0.337 | UV1 0.242 | ST1 0.337 | 20 | Inv. |

The data show that dark stability is improved when the cyclic phosphonate material ST1 is incorporated into the dispersion, even when a lower coupler laydown is used.

Example 8

In this example comparisons are made for a 'NB coupler' (a subset of couplers of formula I) dispersion formulation with and without a stabilizer of formula (I). The dispersion was made as described in Example 4 and coated in the format shown below in TABLE 7

TABLE 7

Structure of Photographic Element

| Layer | Component | Coverage |
|---|---|---|
| Layer 3 | Gelatin | 1.00 $g/m^2$ |
| Layer 2 | Gelatin | 0.60 $g/m^2$ |
| (UV light | UV light absorbing agents: | 0.24 $g/m^2$ |
| absorbing | (UV1:UV3, 1:0.18) | 65.69 $mg/m^2$ |
| layer) | Stain prevention agent, H | 79.93 $mg/m^2$ |
| | Solvent for UV absorbing agents, B | 0.11 $g/m^2$ |
| | Hardener, M | |
| Layer 1 | Gelatin | 1.62 $g/m^2$ |
| (Red-sensitive | Silver chloride emulsion | 0.20 g $Ag/m^2$ |
| layer) | Coupler(s) | see Table 8 |
| Support | Gelatin | 3.00 $g/m^2$ |
| | over polyethylene laminated paper base | |

The coatings were exposed and processed in the same way as described in Example 4. The exposed and processed coatings were tested for light and dark stability.

The light stability of the image dyes was tested by exposing the processed strips to the light from a Xenon arc lamp at an intensity of 50 klux for seven weeks. The fade from the initial density of 1.00 was reported as a percentage under the column heading "Light fade" in TABLE 8.

The dark stability of the image dyes was tested by maintaining the processed strips for 16 weeks at a temperature of 75C. and 50% relative humidity. The fade from the initial density of 1.00 is reported as a percentage in TABLE 8.

TABLE 8

| Element | IIA & laydown ($g/m^2$) | Solvents & laydown ($g/m^2$) | III & laydown ($g/m^2$) | I & laydown ($g/m^2$) | % light fade | % Dark Fade | |
|---|---|---|---|---|---|---|---|
| 121 | AC35 0.23 | F + B 0.435 + 0.145 | UV1 0.354 | — | 23 | 5 | Comp. |
| 122 | AC35 0.23 | F + B 0.435 + 0.145 | UV1 0.354 | ST1 0.354 | 19 | 3 | Inv. |

The results show that the element including a combination of UV absorber and cyclic phosphonate stabiliser provides an improvement in light and dark stability over the element in which the stabiliser was absent.

The patents and publications referred to herein are incorporated by reference in their entirety.

The invention has been described in detail with particular reference to certain preferred embodiments thereof, but it will be understood that variations and modifications can be effected within the spirit and scope of the invention.

What is claimed is:

1. A photographic element comprising at least one light-sensitive silver halide emulsion layer having associated therewith at least one cyan dye-forming coupler, a UV absorber and a stabilizer of formula (I)

(I)

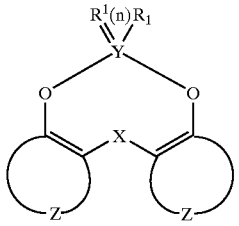

wherein

Y is phosphorous, silicon or boron;

$R_1$ and $R^1$ are independently selected from an unsubstituted or substituted alkyl, aryl, alkoxy, aryloxy group or a substituted amino group;

n is 0 or 1:

provided also that when (a) Y is phosphorous, n is 1 and $R^1$ is oxygen (=O);

(b) Y is silicon, n is 1 and $R_1$ and/or $R^1$ may also be hydrogen or $R_1$ and $R^1$ may combine to complete a 5–10 membered heterocyclic ring which may contain, in addition to Y, one or more heteroatoms selected from nitrogen, oxygen and sulfur, which ring is unsubstituted or substituted; and (c) Y is boron, n is 0;

each Z independently represents the atoms necessary to complete a substituted or unsubstituted arene or heteroaromatic ring system; and X is a single bond or a linking group having an atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

2. A photographic element as claimed in claim 1 wherein the stabilizer has the formula (IA)

(IA)

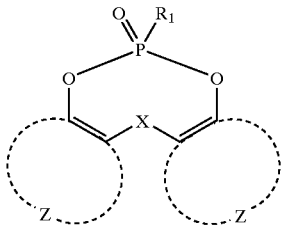

wherein $R_1$ is selected from an unsubstituted or substituted alkyl, aryl, alkoxy, aryloxy group or a substituted amino group;

each Z independently represents the atoms necessary to complete a substituted or unsubstituted arene or heteroaromatic ring system; and X is a single bond or a linking group having an atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

3. A photographic element comprising at least one light-sensitive silver halide emulsion layer having associated therewith at least one cyan dye-forming coupler, a UV absorber and a stabilizer wherein the stabilizer has the formula (IB)

(IB)

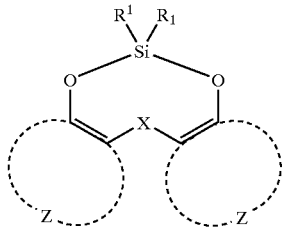

wherein $R_1$ and $R^1$ are independently selected from hydrogen, an unsubstituted or substituted alkyl, aryl, alkoxy, aryloxy group or a substituted amino group; or $R_1$ and $R^1$ may combine to complete a 5–10 membered heterocyclic ring which may contain, in addition to Si, one or more heteroatoms selected from nitrogen, oxygen and sulfur, which ring is unsubstituted or substituted;

each Z independently represents the atoms necessary to complete a substituted or unsubstituted arene or heteroaromatic ring system; and X is a single bond or a linking group having an atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

4. A photographic element as claimed in claim 1 wherein the stabilizer has the formula (IC)

(IC)

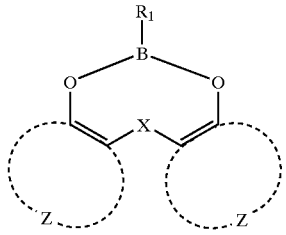

wherein $R_1$ is selected from an unsubstituted or substituted alkyl, aryl, alkoxy, aryloxy group or a substituted amino group;

each Z independently represents the atoms necessary to complete a substituted or unsubstituted arene or heteroaromatic ring system; and X is a single bond or a linking group having an atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

5. A photographic element as claimed in claim 1 wherein $R_1$ and $R^1$ are independently selected from an unsubstituted or substituted methyl, ethyl, butyl, octyl, nonyl, dodecyl, octadecyl, phenyl, methoxy, ethoxy, decyloxy, phenoxy or dimethylamino group or, when Y is a silicon atom, $R_1$ and/or $R^1$ may be hydrogen or $R_1$ and $R^1$ may combine to form a cyclopentyl, cyclohexyl or 1-oxa-4-silacyclohexyl ring.

6. A photographic element as claimed in claim 1 wherein Z represents the atoms necessary to form an unsubstituted or substituted phenyl, naphthalene, pyridine or quinoline ring.

7. A photographic element as claimed in claim 6 wherein Z represents the atoms necessary to form a phenyl group substituted at the ortho and para positions.

8. A photographic element as claimed in claim 1 wherein X is a divalent group selected from —CR'R"—, —NR—, —$S(O)_q$— and —O—, wherein R is an unsubstituted or substituted alkyl or aryl group, R' and R" are independently selected from hydrogen and an unsubstituted or substituted alkyl or aryl group and q is 0,1 or 2.

9. A photographic element as claimed in claim 8 wherein X is a sulfur atom, an oxygen atom or an unsubstituted or substituted methylene group.

10. A photographic element as claimed in claim 1 wherein the stabilizer has the formula (ID)

(ID)

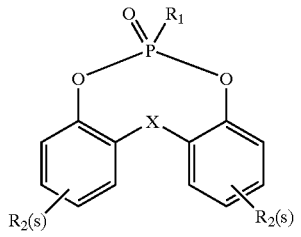

wherein $R_1$ is an unsubstituted or substituted alkyl, aryl, alkoxy, aryloxy group or a substituted amino group;

each $R_2$ and each $R_3$ is independently selected from a halogen atom or an unsubstituted or substituted alkyl, aryl, alkoxy, aryloxy, COOR or CONR'R" group, wherein R is an unsubstituted or substituted alkyl or aryl group, R' and R" are independently selected from hydrogen and an unsubstituted or substituted alkyl or aryl group;

each s is independently an integer from 0 to 4; and

X is a single bond or a linking group having an atom which connects the two phenyl rings; or X forms, together with $R_2$ and $R_3$, when in the ortho position, a fused unsubstituted or substituted 5-, 6- or 7-membered ring, which may contain one or two heteroatoms selected from nitrogen, oxygen and sulfur.

11. A photographic element as claimed in claim 10 wherein each s is 2 and the substituents are in the ortho and para position with respect to the C—O bond.

12. A photographic element as claimed in claim 11 wherein in the ortho position there is an unsubstituted secondary or tertiary alkyl group and in the para position there is a halogen atom or an unsubstituted alkyl group.

13. A photographic element as claimed in claim 1 wherein the stabilizer is selected from

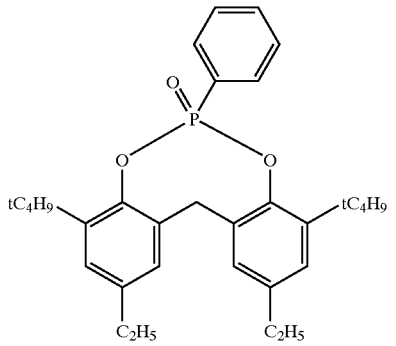

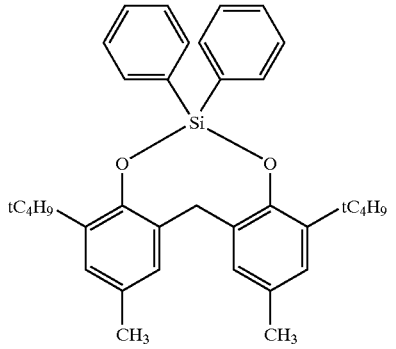

and

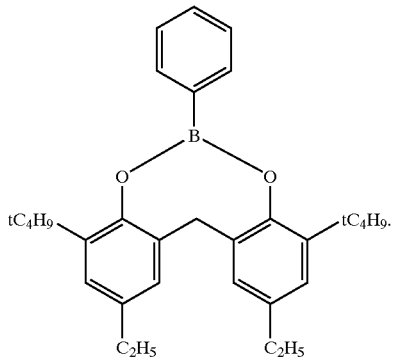

14. A photographic element as claimed in claim 1 wherein the silver halide emulsion layer has associated therewith a phenolic dye-forming coupler of formulae (II):

(II)

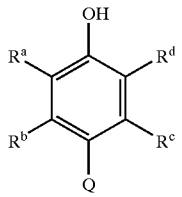

wherein $R^a$ is selected from hydrogen, halogen or an unsubstituted or substituted alkyl, aryl, alkyl- or aryl-amido, alkyl- or aryl-sulfonamido or alkyl- or aryl-ureido group, or a 5–10 membered heterocyclic ring which contains one or more heteroatoms selected from nitrogen, oxygen and sulfur, which ring is unsubstituted or substituted;

$R^b$ is selected from hydrogen or an unsubstituted or substituted alkyl, alkyl- or aryl-amido, alkyl- or aryl-ureido group or an amido or ureido group containing a 5–10 membered heterocyclic ring which contains one or more heteroatoms selected from nitrogen, oxygen and sulfur, which ring is unsubstituted or substituted;

$R^c$ is selected from a hydrogen atom or an oxygen atom linked with $R^d$ to form an oxazole group, which can be further substituted;

$R^d$ is selected from an unsubstituted or substituted alkyl- or aryl-amido, alkyl- or aryl-sulfonamido or alkyl- or aryl-ureido group, or an amido, sulfonamido or ureido group containing a 5–10 membered heterocyclic ring which contains one or more heteroatoms selected from nitrogen, oxygen and sulfur, which ring is unsubstituted or substituted, or is a nitrogen atom linked with $R^c$ to form the oxazole group; and Q is selected from hydrogen or halogen or a group which can be split off by the reaction of coupler with an oxidized colour developing agent.

15. A photographic element as claimed in claim 14 wherein the dye-forming coupler has the structure (IIA)

(IIA)

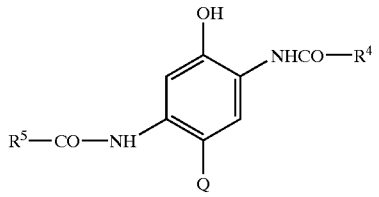

wherein $R^4$ and $R^5$ are independently selected from an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and Q is selected from hydrogen or halogen or a group which can be split off by the reaction of coupler with an oxidized colour developing agent.

16. A photographic element as claimed in claim 15 wherein $R^4$ is an aryl or heterocyclic ring which is unsubstituted or substituted with an electron-withdrawing substituent meta and/or para to the amido group.

17. A photographic element as claimed in claim 15 wherein $R^5$ is the group

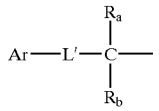

wherein

Ar is an unsubstituted or substituted aryl group;

L' is a divalent linking group and $R_a$ and $R_b$ are independently H or an alkyl group.

18. A photographic element as claimed in claim 17 wherein $R_a$ is an alkyl group, $R_b$ is H and L' is $—SO_2—$.

19. A photographic element as claimed in claim 15 wherein $R^5$ is the group

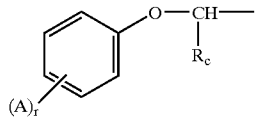

wherein each A is independently a substituent with at least one A being halogen, an alkyl group, hydroxy group, alkyl- or aryl-sulfonamido or -sulfamoyl group, alkoxycarbonyl, carboxylate ester or an alkylcarbonamido group; r is 1 or 2, and $R_c$ is hydrogen or an alkyl group.

20. A photographic element as claimed in claim 14 wherein the dye-forming coupler has the formula (IIB)

(IIB)

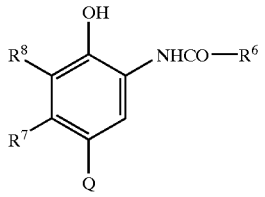

wherein $R^6$ is an unsubstituted or substituted alkyl or aryl group or a 5–10 membered heterocyclic ring which contains one or more heteroatoms selected from nitrogen, oxygen and sulfur, which ring is unsubstituted or substituted;

$R^7$ is an unsubstituted or substituted alkyl group;

$R^8$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted; and Q is selected from hydrogen or halogen or a group which can be split off by the reaction of coupler with an oxidized colour developing agent.

21. A photographic element as claimed in claim 20 wherein $R^6$ is a substituted alkyl group, $R^7$ is an unsubstituted alkyl group and $R^8$ is halogen or an unsubstituted or substituted alkyl group.

22. A photographic element as claimed in claim 14 wherein the dye-forming coupler has the formula (IIC)

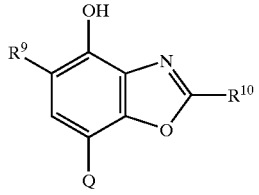

wherein $R^9$ is selected from hydrogen, halogen or an unsubstituted or substituted alkyl, aryl, alkyl- or aryl-amido, alkyl- or aryl-sulfonamido or alkyl- or aryl-ureido group, $R^{10}$ is selected from an unsubstituted or substituted alkyl, aryl, amino, alkoxy, alkoxycarbonyl, alkyl- or aryl-amido, alkyl- or aryl-sulfonamido or alkyl- or aryl-ureido group; and Q is selected from hydrogen or halogen or a group which can be split off by the reaction of coupler with an oxidized colour developing agent.

23. A photographic element as claimed in claim 22 wherein $R^9$ is hydrogen, an aryl group substituted with one or more halogen atoms, an alkylamido, substituted arylamido or an arylureido group and $R^{10}$ is an alkyl group, substituted with an aryloxy or alkyl- or aryl-sulfonyl group or an alkylamido or alkoxycarbonyl group.

24. A photographic element as claimed in claim 1 wherein the UV absorber is a benzotriazole of formula (III):

(III)

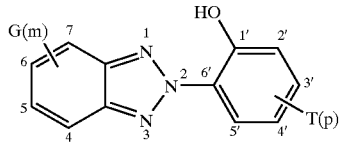

wherein each G is an independently selected substituent and m is 0 to 4; and each T is an independently selected substituent and p is 0 to 4.

25. A photographic element as claimed in claim 24 wherein each G is independently selected from hydrogen, halogen, nitro and an unsubstituted or substituted alkyl, aryl, alkoxy, aryloxy, acyloxy, alkyl- or aryl-thio, mono- or di-alkylamino, acylamino, alkoxycarbonyl and a 5-membered or 6-membered heterocyclic group containing a nitrogen, oxygen or sulfur atom, and m is 0 to 4.

26. A photographic element as claimed in claim 24 wherein each T is selected from hydrogen, halogen and an unsubstituted or substituted alkyl, aryl, alkoxy, aryloxy, acyloxy, alkyl- or aryl-thio, mono- or di-alkylamino, acylamino and a 5-membered or 6-membered heterocyclic group containing a nitrogen, oxygen or sulfur atom, and p is 0 to 4.

27. A photographic element as claimed in claim 1 wherein the laydown of total coupler is from about 0.01 mmol/$m^2$ to about 1.5 mmol/$m^2$.

28. A photographic element as claimed in claim 1 wherein the ratio of either stabilizer of formula (I) or UV absorber to total coupler is from about 0.01:1 to about 4:1.

29. A photographic element as claimed in claim 1 wherein the ratio of solvent to total coupler is from about 0.2:1 to about 4:1.

30. A multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element comprises at least one light-sensitive silver halide emulsion layer having associated therewith at least one cyan dye-forming coupler, a UV absorber and a stabilizer of formula (I)

(I)

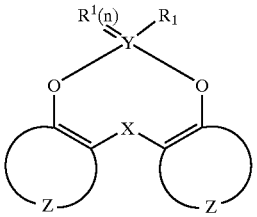

wherein

Y is phosphorous, silicon or boron;

$R_1$ and $R^1$ are independently selected from an unsubstituted or substituted alkyl, aryl, alkoxy, aryloxy group or a substituted amino group;

n is 0 or 1:

provided also that when (a) Y is phosphorous, n is 1 and $R^1$ is oxygen (=O);

(b) Y is silicon, n is 1 and $R_1$ and/or $R^1$ may also be hydrogen or $R_1$ and $R^1$ may combine to complete a 5–10 membered heterocyclic ring which may contain, in addition to Y, one or more heteroatoms selected from nitrogen, oxygen and sulfur, which ring is unsubstituted or substituted; and (c) Y is boron, n is 0;

each Z independently represents the atoms necessary to complete a substituted or unsubstituted arene or heteroaromatic ring system; and X is a single bond or a linking group having an atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

31. A process of forming an image in a photographic element after the element has been imagewise exposed to light, comprising contacting an element with a colour developing agent, wherein the element comprises at least one light-sensitive silver halide emulsion layer having associated therewith at least one cyan dye-forming coupler, a UV absorber and a stabilizer of formula (I)

(I)

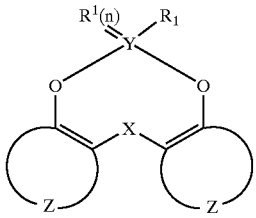

wherein

Y is phosphorous, silicon or boron;

$R_1$ and $R^1$ are independently selected from an unsubstituted or substituted alkyl, aryl, alkoxy, aryloxy group or a substituted amino group;

n is 0 or 1:

provided also that when (a) Y is phosphorous, n is 1 and $R^1$ is oxygen (=O);

(b) Y is silicon, n is 1 and $R_1$ and/or $R^1$ may also be hydrogen or $R_1$ and $R^1$ may combine to complete a 5–10 membered heterocyclic ring which may contain, in addition to Y, one or more heteroatoms selected from nitrogen, oxygen and sulfur, which ring is unsubstituted or substituted; and (c) Y is boron, n is 0;

each Z independently represents the atoms necessary to complete a substituted or unsubstituted arene or heteroaromatic ring system; and X is a single bond or a linking group having an atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

* * * * *